US011162037B2

(12) United States Patent
Emanuele et al.

(10) Patent No.: US 11,162,037 B2
(45) Date of Patent: Nov. 2, 2021

(54) PYROLYSIS TAR CONVERSION

(71) Applicant: ExxonMobil Chemical Patents Inc., Baytown, TX (US)

(72) Inventors: Krystle J. Emanuele, Houston, TX (US); Kapil Kandel, Humble, TX (US); Glenn A. Heeter, The Woodlands, TX (US); Jeffrey C. Yeh, Houston, TX (US); Teng Xu, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 178 days.

(21) Appl. No.: 16/467,790

(22) PCT Filed: Dec. 1, 2017

(86) PCT No.: PCT/US2017/064128
§ 371 (c)(1),
(2) Date: Jun. 7, 2019

(87) PCT Pub. No.: WO2018/111573
PCT Pub. Date: Jun. 21, 2018

(65) Prior Publication Data

US 2019/0300803 A1 Oct. 3, 2019

Related U.S. Application Data

(60) Provisional application No. 62/561,478, filed on Sep. 21, 2017, provisional application No. 62/435,238, filed on Dec. 16, 2016.

(51) Int. Cl.

| | |
|---|---|
| ***C10G 69/06*** | (2006.01) |
| ***C10G 1/00*** | (2006.01) |
| ***C10G 1/02*** | (2006.01) |
| ***C10G 45/00*** | (2006.01) |

(52) U.S. Cl.
CPC ..... *C10G 69/06* (2013.01); *C10G 1/002* (2013.01); *C10G 1/02* (2013.01); *C10G 45/00* (2013.01); *C10G 2300/302* (2013.01); *C10G 2400/06* (2013.01)

(58) Field of Classification Search
CPC ..... C10G 69/06
See application file for complete search history.

(56) References Cited

U.S. PATENT DOCUMENTS

| | | | | |
|---|---|---|---|---|
| 4,312,742 | A * | 1/1982 | Hayashi | C10C 3/00 208/131 |
| 5,871,634 | A | 2/1999 | Wiehe et al. | |
| 9,090,835 | B2 | 7/2015 | Beech, Jr. et al. | |
| 9,090,836 | B2 | 7/2015 | Brown et al. | |
| 9,102,884 | B2 | 8/2015 | Xu et al. | |
| 9,580,523 | B2 | 2/2017 | Wong et al. | |
| 9,637,694 | B2 | 5/2017 | Evans et al. | |
| 9,657,239 | B2 | 5/2017 | Beech, Jr. et al. | |
| 10,072,218 | B2 | 9/2018 | Chen et al. | |
| 2010/0288679 | A1 | 11/2010 | Himelfarb | |
| 2013/0081979 | A1 | 4/2013 | Brown et al. | |
| 2014/0061094 | A1 | 3/2014 | Xu et al. | |
| 2014/0061095 | A1* | 3/2014 | Beech, Jr. | C10G 69/06 208/73 |
| 2014/0061096 | A1 | 3/2014 | Brown et al. | |
| 2014/0061100 | A1 | 3/2014 | Lattner et al. | |
| 2014/0174980 | A1 | 6/2014 | Brown et al. | |
| 2015/0122701 | A1 | 5/2015 | Shih et al. | |
| 2015/0141717 | A1 | 5/2015 | Frey et al. | |
| 2015/0315496 | A1 | 11/2015 | Soultanidis et al. | |
| 2015/0344785 | A1 | 12/2015 | Soultanidis et al. | |
| 2015/0344790 | A1 | 12/2015 | Ferrughelli et al. | |
| 2015/0353851 | A1 | 12/2015 | Buchanan | |
| 2015/0361354 | A1 | 12/2015 | Xu et al. | |
| 2015/0361359 | A1 | 12/2015 | Beech, Jr. et al. | |
| 2015/0368570 | A1 | 12/2015 | Beech, Jr. et al. | |
| 2016/0122667 | A1 | 5/2016 | Evans et al. | |
| 2016/0177205 | A1 | 6/2016 | Evans et al. | |
| 2017/0002273 | A1 | 1/2017 | Rubin-Pitel et al. | |
| 2019/0016969 | A1 | 1/2019 | Kandel et al. | |
| 2019/0300803 | A1 | 10/2019 | Emanuele et al. | |
| 2019/0367822 | A1 | 12/2019 | Kandel et al. | |
| 2019/0367825 | A1 | 12/2019 | Heeter et al. | |
| 2020/0063046 | A1 | 2/2020 | Kandel et al. | |
| 2020/0071627 | A1 | 3/2020 | Xu et al. | |

FOREIGN PATENT DOCUMENTS

| | | |
|---|---|---|
| WO | 2013/033580 A | 3/2013 |
| WO | 2013/033582 A | 3/2013 |
| WO | 2013/033590 A | 3/2013 |
| WO | 2015/191236 A | 12/2015 |

OTHER PUBLICATIONS

Process Pro Eric "Mitigating Hydroprocessing Reactor Fouling", Refiner Link, Jun. 16, 2014. (URL: http://www.refinerlink.com/blog/Mitigating_Hydroprocessing_Reactor_Fouling/).
U.S. Appl. No. 62/380,538, filed Aug. 29, 2016.

* cited by examiner

*Primary Examiner* — Randy Boyer

(57) ABSTRACT

This invention relates to a process for determining the suitability of pyrolysis tar, such as steam cracker tar, for upgrading using hydroprocessing without excessive fouling of the hydroprocessing reactor. The invention includes establishing a reference activity for the thermally treating the pyrolysis tar to produce a treated tar having a lesser reactivity.

19 Claims, 4 Drawing Sheets

PYROLYSIS TAR CONVERSION

CROSS-REFERENCE OF RELATED APPLICATIONS

Priority Claim

This application is a National Phase Application claiming priority to P.C.T. Patent Application Serial No. PCT/US2017/064128 filed Dec. 1, 2017, which claims priority to and the benefit of U.S. Patent Application Ser. No. 62/561,478, filed Sep. 21, 2017; and U.S. Patent Application Ser. No. 62/435,238, filed Dec. 16, 2016, which are incorporated by reference in their entireties.

RELATED APPLICATIONS

This application is related to the following applications: U.S. patent application Ser. No. 15/829,034, filed Dec. 1, 2017; U.S. Patent Application Ser. No. 62/525,345, filed Jun. 27, 2017; PCT Patent Application No. PCT/US17/64117, filed Dec. 1, 2017; U.S. Patent Application Ser. No. 62/571,829, filed Oct. 13, 2017; PCT Patent Application No. PCT/US17/64140, filed Dec. 1, 2017; PCT Patent Application No. PCT/US17/64165, filed Dec. 1, 2017; PCT Patent Application No. PCT/US17/64176, filed Dec. 1, 2017, which are incorporated by reference in their entireties.

FIELD

This invention relates to a process for determining the suitability of pyrolysis tar, such as steam cracker tar, for upgrading using hydroprocessing without excessive fouling of the hydroprocessing reactor. The invention also relates to sampling the pyrolysis tar, analyzing the sample, and using the analysis to determine conditions under which the tar can be treated and/or hydroprocessed.

BACKGROUND

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is conducted by steam cracking, the pyrolysis tar is identified as steam-cracker tar ("SCT").

Pyrolysis tar is a high-boiling, viscous, reactive material comprising complex molecules and macromolecules that can foul equipment and conduits which contact the tar. Pyrolysis tar typically comprises compounds which include hydrocarbon rings, e.g., hydrocarbons rings having hydrocarbon side chains, such as methyl and/or ethyl side chains. Depending to some extent on features such as molecular weight, molecules and aggregates present in the pyrolysis tar can be both relatively non-volatile and paraffin insoluble, e.g., pentane insoluble and heptane-insoluble. Particularly challenging pyrolysis tars contain >1 wt. % toluene insoluble compounds. Such toluene insoluble are typically high molecular weight compounds, e.g., multi-ring structures that are also referred to as tar heavies ("TH"). These high molecular weight molecules can be generated during the pyrolysis process, and their high molecular weight leads to high viscosity, which makes the tar difficult to process and transport.

Blending pyrolysis tar with lower viscosity hydrocarbons has been proposed for improved processing and transport of pyrolysis tar. However, when blending heavy hydrocarbons, fouling of processing and transport facilities can occur as a result of precipitation of high molecular weight molecules, such as asphaltenes. See, e.g., U.S. Pat. No. 5,871,634, which is incorporated herein by reference in its entirety. In order to mitigate asphaltene precipitation, methods can be used to guide the blending process, e.g., methods which include determining an Insolubility Number ("$I_N$") and/or Solvent Blend Number ("$S_{BN}$") for the blend and/or components thereof. Successful blending can be accomplished with little or substantially no asphaltene precipitation by combining the components in order of decreasing $S_{BN}$, so that the $S_{BN}$ of the blend is greater than the $I_N$ of any component of the blend. Pyrolysis tars generally have high $S_{BN}$>135 and high $I_N$>80 making them difficult to blend with other heavy hydrocarbons without precipitating asphaltenes Pyrolysis tars having $I_N$>100, e.g., >110, e.g., >130, are particularly difficult to blend without phase separation occurring.

Attempts at pyrolysis tar hydroprocessing to reduce viscosity and improve both $I_N$ and $S_{BN}$ have been attempted, but challenges remain—primarily resulting from fouling of process equipment. For example, hydroprocessing of neat SCT results in rapid catalyst deactivation when the hydroprocessing is carried out at a temperature in the range of about 250° C. to 380° C., a pressure in the range of about 5400 kPa to 20,500 kPa, using a conventional hydroprocessing catalyst containing one or more of Co, Ni, or Mo. This deactivation has been attributed to the presence of TH in the SCT, which leads to the formation of undesirable deposits (e.g., coke deposits) on the hydroprocessing catalyst and the reactor internals. As the amount of these deposits increases, the yield of the desired upgraded pyrolysis tar (e.g., upgraded SCT) decreases and the yield of undesirable byproducts increases. The hydroprocessing reactor pressure drop also increases, often to a point where the reactor becomes inoperable before a desired reactor run length can be achieved.

One approach taken to overcome these difficulties is disclosed in International Patent Application Publication No. WO 2013/033580, which is incorporated herein by reference in its entirety. The application discloses hydroprocessing SCT in the presence of a utility fluid comprising a significant amount of single and multi-ring aromatics to form an upgraded pyrolysis tar product. The upgraded pyrolysis tar product generally has a decreased viscosity, decreased atmospheric boiling point range, and increased hydrogen content over that of the pyrolysis tar component of the hydroprocessor feed, resulting in improved compatibility with fuel oil and other common blend-stocks. Additionally, efficiency advances involving recycling a portion of the upgraded pyrolysis tar product as utility fluid are described in International Publication No. WO 2013/033590 which is also incorporated herein by reference in its entirety.

Another improvement, disclosed in U.S. Patent Application Publication No. 2015/0315496, which is incorporated herein by reference in its entirety, includes separating and recycling a mid-cut utility fluid from the upgraded pyrolysis tar product. The utility fluid comprises ≥10.0 wt. % aromatic and non-aromatic ring compounds and each of the following: (a) ≥1.0 wt. % of 1.0 ring class compounds; (b) ≥5.0 wt. % of 1.5 ring class compounds; (c) ≥5.0 wt. % of 2.0 ring class compounds; and (d) ≥0.1 wt. % of 5.0 ring class compounds. Improved utility fluids are also disclosed in the following patent applications, each of which is incorporated by references in its entirety. U.S. Patent Application Publication No. 2015/0368570 discloses separating and recycling a utility fluid from the upgraded pyrolysis tar product. The utility fluid contains 1-ring and/or 2-ring aromatics and has a final boiling point ≤430° C. U.S. Patent Application Publication No. 2016/0122667 discloses utility fluid which contains 2-ring and/or 3-ring aromatics and has solubility blending number ($S_{BN}$)≥120.

Despite these advances, there remains a need for further improvements in the hydroprocessing of pyrolysis tars which allow the production of upgraded tar product at appreciable hydroprocessing reactor run lengths.

SUMMARY

It has been discovered that a mixture of pyrolysis tar and the specified utility fluid can be hydroprocessed for an appreciable reactor run length without undue reactor fouling, provided the mixture has a reactivity that does not exceed a reference reactivity level. The mixture's reactivity ("$R_M$") can be determined by measuring the mixture's Bromine Number (in units of "BN"). It has been found that for a wide range of desirable pyrolysis tar hydroprocessing conditions, a reference reactivity level can be specified for the processing conditions. The reference reactivity value ("$R_{Ref}$") can be pre-determined and corresponds to the greatest reactivity (in units of BN) a pyrolysis tar-utility fluid mixture can have without undue reactor fouling occurring during hydroprocessing, under predetermined hydroprocessing conditions. Accordingly, the reactivity $R_M$ can be compared with $R_{Ref}$, and processing decisions can be based on the comparison. When $R_M$ is $\leq R_{Ref}$, the pyrolysis tar-utility fluid mixture can be hydroprocessed with decreased reactor fouling and increased run-lengths under conditions identified as Standard Hydroprocessing Conditions. Advantageously, $R_M$ can be determined using a suitably prepared sample of pyrolysis tar and the utility fluid at ambient (e.g., 25° C.) temperature, even though the pyrolysis tar is obtained from a pyrolysis tar source, such as a tar knock out drum, having a much greater temperature, e.g., in a range of about 140° C. to 310° C. This greatly simplifies the measurement of $R_M$.

Accordingly, certain aspects of the invention relate to a process for upgrading a pyrolysis tar, e.g., a tar derived from the pyrolysis of hydrocarbon, such as a steam cracker tar. At least 70 wt. % of the pyrolysis tar's components have a normal boiling point of at least 290° C. In accordance with the process, the pyrolysis tar is thermally treated before hydroprocessing. The thermal treatment includes maintaining the pyrolysis tar at a temperature in the range of from 150° C. to 320° C. for a time $t_{HS}$ of at least 1 minute to produce a pyrolysis tar composition (a treated pyrolysis tar). The pyrolysis tar composition is combined with the specified utility fluid to produce a tar-fluid mixture having a reactivity $R_M$. The tar-fluid mixture is conducted to a hydroprocessing reactor having a predetermined reference reactivity $R_{Ref}$. The hydroprocessing can be carried out long-term without significant fouling under Standard Hydroprocessing Conditions when the tar-fluid mixture has an $R_M \leq R_{Ref}$. In other aspects, the tar-fluid mixture has an $R_M$ that is both $>R_{Ref}$ and ≤18 BN. Such a tar-fluid mixture can be hydroprocessed under Mild Hydroprocessing Conditions long-term without significant fouling.

BRIEF DESCRIPTION OF THE DRAWINGS

The drawings are for illustrative purposes only and are not intended to limit the scope of the present invention.

DETAILED DESCRIPTION

Figure 1:
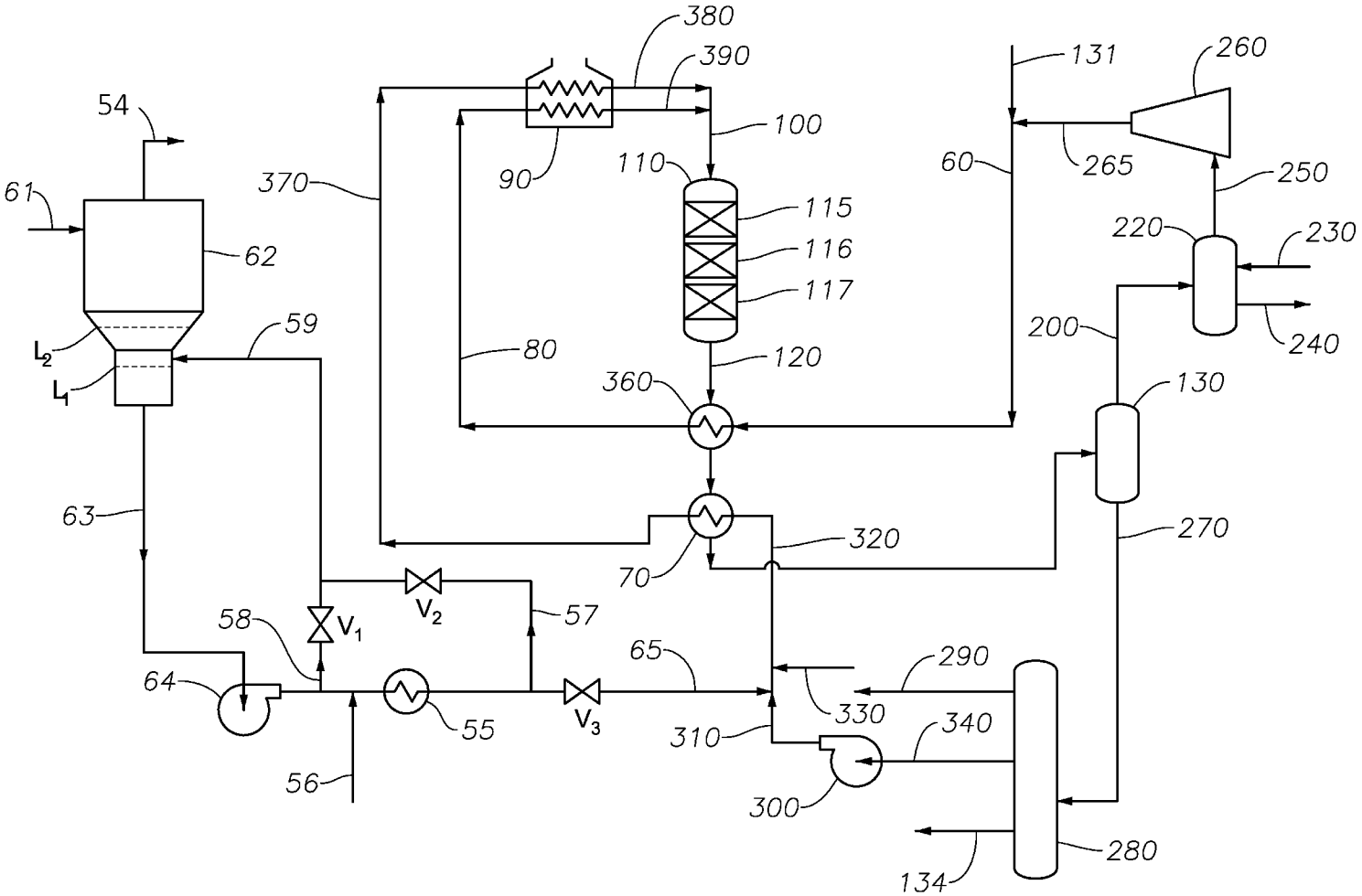
FIG. 1 is a schematic representing certain forms of pyrolysis tar hydroprocessing.

A tar-fluid mixture comprising pyrolysis tar is evaluated for its reactivity to evaluate its potential for fouling the reactor at desired hydroprocessing conditions. In one aspect of the invention, reactivity is determined, for instance, by measuring the bromine number of the tar-fluid mixture. A pyrolysis tar sample can be obtained, e.g., from a tar drum, and cooled to a temperature of about 25° C. The tar sample is combined with a sufficient amount of the specified utility fluid to produce the tar-fluid mixture. $R_M$ of the tar-fluid mixture is measured in units of BN. $R_T$ is compared to a pre-determined reference value $R_{Ref}$. Typically $R_M$ and $R_{Ref}$ are determined using substantially the same methods and process conditions, e.g., determining BN of tar-fluid mixtures comprising substantially the same amount of substantially the same utility fluid. The comparison of $R_M$ and $R_{Ref}$ is used to select from among various processing options for the pyrolysis tar. For example, the comparison can be used to determine whether (a) a tar-fluid mixture comprising a particular pyrolysis tar is a suitable candidate for hydroprocessing under the specified Standard Hydroprocessing Conditions, e.g., when $R_M$ is $\leq R_{Ref}$, such as $R_M$ is $\leq 0.5*R_{Ref}$, or $R_M$ is $\leq 0.1*R_{Ref}$. When $R_M$ of the tar-fluid mixture is $>R_{Ref}$, the available processing options include further processing of the tar-fluid mixture's tar component to achieve a tar-fluid mixture $R_M$ that is $\leq R_{Ref}$, and then hydroprocessing the further-processed tar-fluid mixture comprising the further processed tar under Standard Hydroprocessing Conditions; and/or conducting the tar away without utility fluid mixing or hydroprocessing. Optionally, a tar-fluid mixture having an $R_M$ that is both $>R_{Ref}$ and ≤18 BN can be hydroprocessed under Mild Hydroprocessing Conditions. However, it can be more beneficial to conduct away the pyrolysis tar or a portion thereof when (i) the value of a hydroprocessed tar produced using Mild Hydroprocessing Conditions is not sufficient to justify the cost of the hydroprocessing and/or (ii) the value of a hydroprocessed tar is not sufficient to justify the cost of the further treatment.

Certain methods for evaluating reactivity of a tar-fluid mixture, certain methods for upgrading the pyrolysis tar component of the tar-fluid mixture, and certain processing options for the tar-fluid mixture will now be described in more detail. The invention is not limited to these, and this descriptions is not meant to foreclose the use of other methods, processes, apparatus, systems, etc. within the broader scope of the invention. Reference will be made to the following defined terms in this description and appended claims.

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥about 550° F. (290° C.). Certain pyrolysis tars have an initial boiling point ≥200° C. For certain pyrolysis tars, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components, and (ii) a number of carbon atoms ≥about 15. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. Pyrolysis tar 50° C. kinematic viscosity is ≥500 cSt. "SCT" means pyrolysis tar obtained from steam cracking.

"Aliphatic olefin component" or "aliphatic olefin content" means the portion of the tar that contains hydrocarbon molecules having olefinic unsaturation (at least one unsaturated carbon that is not an aromatic unsaturation) where the hydrocarbon may or may not also have aromatic unsaturation. For instance, a vinyl hydrocarbon like styrene, if present in the pyrolysis tar, would be included aliphatic olefin content. Pyrolysis tar reactivity has been found to correlate strongly with the pyrolysis tar's aliphatic olefin content. Although it is typical to determine reactivity $R_M$ of a tar-fluid mixture comprising the pyrolysis tar, it is within the scope of the invention to determine reactivity of the pyrolysis tar itself. Utility fluids generally have a reactivity $R_U$ that is much less than pyrolysis tar reactivity. Accordingly, $R_T$ of a pyrolysis tar can be derived from $R_M$ of a tar-fluid mixture comprising the pyrolysis tar, and vice versa, using the relationship $R_M$~[$R_T$*(weight of tar)+$R_U$*(weight of utility fluid)]/(weight of tar+weight of utility fluid). For instance, if a utility fluid having $R_U$ of 3, and the utility fluid is 40% by weight of the tar-fluid mixture, and if $R_T$ (the reactivity of the pyrolysis tar alone) is 18 BN, then $R_M$ is approximately 12 BN.

"Tar Heavies" (TH) are a product of hydrocarbon pyrolysis having an atmospheric boiling point ≥565° C. and comprising ≥5.0 wt. % of molecules having a plurality of aromatic cores based on the weight of the product. The TH are typically solid at 25° C. and generally include the fraction of SCT that is not soluble in a 5:1 (vol:vol) ratio of n-pentane:SCT at 25° C. TH generally includes asphaltenes and other high molecular weight molecules.

A pyrolysis tar's Insolubles Content ("IC") means the amount in wt. % (based on the weight of the pyrolysis tar) of pyrolysis tar components that are insoluble in a mixture of 25% by volume heptane and 75% by volume toluene. IC is determined as follows. First, obtain a pyrolysis tar and estimate the pyrolysis tar's asphaltene content, e.g., using conventional methods. Next, produce a mixture by adding a test portion of the heptane-toluene mixture to a flask containing a test portion of the pyrolysis tar of weight $W_1$. The test portion of the heptane-toluene mixture is added to the test portion of the heptane-toluene mixture at ambient conditions of 25° C. and 1 bar (absolute) pressure. The following table indicates the pyrolysis test portion amount ($W_1$, in grams), the heptane-toluene mixture amount (in mL), and the Flask volume (in mL) as a function of the pyrolysis tar's estimated asphaltene content.

TABLE 1

Test Portion Size, Flask, and Heptane Volumes

| Estimated Asphaltene Content % m/m | Test Portion Size g | Flask Volume mL | Heptane Volume mL |
|---|---|---|---|
| Less than 0.5 | 10 ± 2 | 1000 | 300 ± 60 |
| 0.5 to 2.0 | 8 ± 2 | 500 | 240 ± 60 |
| Over 2.0 to 5.0 | 4 ± 1 | 250 | 120 ± 30 |
| Over 5.0 to 10.0 | 2 ± 1 | 150 | 60 ± 15 |
| Over 10.0 to 25.0 | 0.8 ± 0.2 | 100 | 25 to 30 |
| Over 25.0 | 0.5 ± 0.2 | 100 | 25 ± 1 |

While maintaining the ambient conditions, cap the flask and mix the heptane-toluene mixture with the pyrolysis tar in the flask until substantially all of the pyrolysis tar has dissolved, and then allow the contents of the capped flask to rest for at least 12 hours. Next, decant the rested contents of the flask through a filter paper of 2 μm pore size and weight $W_2$ positioned within a Buchner funnel. Next, wash the filter paper with fresh heptane-toluene mixture (25/75 vol:vol), and allow the filter paper to dry. Next, place the dried filter paper in an oven to allow the filter paper to achieve a temperature of 60° C. for a time period in the range of from 10 minutes to 30 minutes, and allow the filter paper to cool. Next, record the weight $W_3$ of the cooled filter paper. IC is determined from the equation $IC=(W_3-W_2)/W_1$. It is particularly desired for fuel oils, and even more particularly for transportation fuel oils such as marine fuel oils, to have an IC that is ≤6 wt. %, e.g., ≤5 wt. %, such as ≤4 wt. %, or ≤3 wt. %, or ≤2 wt. %, or ≤1 wt. %.

Aspects of the invention will now be described which include (i) establishing an $R_{Ref}$ for desired hydroprocessing conditions, (ii) obtaining pyrolysis tar from a pyrolysis tar source, (iii) combining the pyrolysis tar with a sufficient amount of the specified utility fluid to produce a tar-fluid mixture, (iv) measuring $R_M$ of the tar-fluid mixture, and (v) comparing $R_M$ to $R_{Ref}$. When $R_M$ is $>R_{Ref}$, and in particular when $R_M$ is >18, additional pyrolysis tar from the pyrolysis tar source can be subjected to one or more thermal treatments or re-treatments to produce a treated or re-treated tar, which is then re-analyzed as in steps (iii)-(v). As a first alternative to the treating or re-treating, additional pyrolysis tar from the pyrolysis tar source can be conducted away, e.g., without forming a tar-fluid mixture. As a second alternative to or in addition to treating or re-treating, when both $R_M>R_{Ref}$ and $R_M\leq18$ BN, e.g., ≤17 BN, such as ≤16 BN, or ≤14 BN, or ≤13 BN, the tar-fluid mixture comprising the pyrolysis tar, the treated pyrolysis tar, or the re-treated pyrolysis tar can be conducted as hydroprocessor feed to a hydroprocessing stage operating under Mild Hydroprocessing Conditions to produce a hydroprocessed tar. When $R_M$ is $<R_{Ref}$, the tar-fluid mixture comprising the pyrolysis tar, the treated pyrolysis tar, or the re-treated pyrolysis tar can be conducted as hydroprocessor feed to a hydroprocessing stage operating under Standard Hydroprocessing Conditions to produce a hydroprocessed tar. Representative pyrolysis tars that may benefit from the foregoing processing will now be described in more detail. The invention is not limited to these pyrolysis tars, and this description is not meant to foreclose other pyrolysis tars within the broader scope of the invention.

Pyrolysis Tar

Pyrolysis tar is a product or by-product of hydrocarbon pyrolysis, e.g., steam cracking. Effluent from the pyrolysis is typically in the form of a mixture comprising unreacted feed, unsaturated hydrocarbon produced from the feed during the pyrolysis, and pyrolysis tar. The pyrolysis tar typically comprises ≥90 wt. %, of the pyrolysis effluent's molecules having an atmospheric boiling point of ≥290° C. Besides hydrocarbon, the feed to pyrolysis optionally further comprise diluent, e.g., one or more of nitrogen, water, etc. Steam cracking, which produces SCT, is a form of pyrolysis which uses a diluent comprising an appreciable amount of steam. Steam cracking will now be described in more detail. The invention is not limited to pyrolysis tars produced by steam cracking, and this description is not meant to foreclose producing pyrolysis tar by other pyrolysis methods within the broader scope of the invention.

Steam Cracking

A steam cracking plant typically comprises a furnace facility for producing steam cracking effluent and a recovery facility for removing from the steam cracking effluent a plurality of products and by-products, e.g., light olefin and pyrolysis tar. The furnace facility generally includes a plurality of steam cracking furnaces. Steam cracking furnaces typically include two main sections: a convection section and a radiant section, the radiant section typically containing fired heaters. Flue gas from the fired heaters is conveyed out of the radiant section to the convection section. The flue gas flows through the convection section and is then conducted away, e.g., to one or more treatments for removing combustion by-products such as NOR. Hydrocarbon is introduced into tubular coils (convection coils) located in the convection section. Steam is also introduced into the coils, where it combines with the hydrocarbon to produce a steam cracking feed. The combination of indirect heating by the flue gas and direct heating by the steam leads to vaporization of at least a portion of the steam cracking feed's hydrocarbon component. The steam cracking feed containing the vaporized hydrocarbon component is then transferred from the convection coils to tubular radiant tubes located in the radiant section. Indirect heating of the steam cracking feed in the radiant tubes results in cracking of at least a portion of the steam cracking feed's hydrocarbon component. Steam cracking conditions in the radiant section, can include, e.g., one or more of (i) a temperature in the range of 760° C. to 880° C., (ii) a pressure in the range of from 1.0 to 5.0 bars (absolute), or (iii) a cracking residence time in the range of from 0.10 to 2.0 seconds.

Steam cracking effluent is conducted out of the radiant section and is quenched, typically with water or quench oil. The quenched steam cracking effluent ("quenched effluent") is conducted away from the furnace facility to the recovery facility, for separation and recovery of reacted and unreacted components of the steam cracking feed. The recovery facility typically includes at least one separation stage, e.g., for separating from the quenched effluent one or more of light olefin, steam cracker naphtha, steam cracker gas oil, SCT, water, light saturated hydrocarbon, molecular hydrogen, etc.

Steam cracking feed typically comprises hydrocarbon and steam, e.g., ≥10.0 wt. % hydrocarbon, based on the weight of the steam cracking feed, e.g., ≥25.0 wt. %, ≥50.0 wt. %, such as ≥65 wt. %. Although the hydrocarbon can comprise one or more light hydrocarbons such as methane, ethane, propane, butane, etc., it can be particularly advantageous to include a significant amount of higher molecular weight hydrocarbon. While doing so typically decreases feed cost, steam cracking such a feed typically increases the amount of SCT in the steam cracking effluent. One suitable steam cracking feed comprises ≥1.0 wt. %, e.g., ≥10 wt. %, such as ≥25.0 wt. %, or ≥50.0 wt. % (based on the weight of the steam cracking feed) of hydrocarbon compounds that are in the liquid and/or solid phase at ambient temperature and atmospheric pressure.

The steam cracking feed comprises water and hydrocarbon. The hydrocarbon typically comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥about 0.1 wt. % asphaltenes. When the hydrocarbon includes crude oil and/or one or more fractions thereof, the crude oil is optionally desalted prior to being included in the steam cracking feed. A crude oil fraction can be produced by separating atmospheric pipestill ("APS") bottoms from a crude oil followed by vacuum pipestill ("VPS") treatment of the APS bottoms. One or more vapor-liquid separators can be used upstream of the radiant section, e.g., for separating and conducting away a portion of any non-volatiles in the crude oil or crude oil components. In certain aspects, such a separation stage is integrated with the steam cracker by preheating the crude oil or fraction thereof in the convection section (and optionally by adding of dilution steam), separating a bottoms steam comprising non-volatiles, and then conducting a primarily vapor overhead stream as feed to the radiant section.

Suitable crude oils include, e.g., high-sulfur virgin crude oils, such as those rich in polycyclic aromatics. For example, the steam cracking feed's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

SCT is typically removed from the quenched effluent in one or more separation stages, e.g., as a bottoms stream from one or more tar drums. Such a bottoms stream typically comprises ≥90.0 wt. % SCT, based on the weight of the bottoms stream. The SCT can have, e.g., a boiling range ≥about 550° F. (290° C.) and can comprise molecules and mixtures thereof having a number of carbon atoms ≥about 15. Typically, quenched effluent includes ≥1.0 wt. % of $C_2$ unsaturates and ≥0.1 wt. % of TH, the weight percents being based on the weight of the pyrolysis effluent. It is also typical for the quenched effluent to comprise ≥0.5 wt. % of TH, such as ≥1.0 wt. % TH.

Representative SCTs will now be described in more detail. The invention is not limited to these SCTs, and this description is not meant to foreclose the processing of other pyrolysis tars within the broader scope of the invention.

Steam Cracker Tar

Conventional separation equipment can be used for separating SCT and other products and by-products from the quenched steam cracking effluent, e.g., one or more flash drums, knock out drums, fractionators, water-quench towers, indirect condensers, etc. Suitable separation stages are described in U.S. Pat. No. 8,083,931, for example. SCT can be obtained from the quenched effluent itself and/or from one or more streams that have been separated from the quenched effluent. For example, SCT can be obtained from a steam cracker gas oil stream and/or a bottoms stream of the steam cracker's primary fractionator, from flash-drum bottoms (e.g., the bottoms of one or more tar knock out drums located downstream of the pyrolysis furnace and upstream of the primary fractionator), or a combination thereof. Certain SCTs are a mixture of primary fractionator bottoms and tar knock-out drum bottoms.

A typical SCT stream from one or more of these sources generally contains ≥90.0 wt. % of SCT, based on the weight of the stream, e.g., ≥95.0 wt. %, such as ≥99.0 wt. %. More than 90 wt. % of the remainder of the SCT stream's weight (e.g., the part of the stream that is not SCT, if any) is typically particulates. The SCT typically includes ≥50.0 wt. %, e.g., ≥75.0 wt. %, such as ≥90.0 wt. % of the quenched effluent's TH, based on the total weight TH in the quenched effluent.

The TH are typically in the form of aggregates which include hydrogen and carbon and which have an average size in the range of 10.0 nm to 300.0 nm in at least one dimension and an average number of carbon atoms ≥50. Generally, the TH comprise ≥50.0 wt. %, e.g., ≥80.0 wt. %, such as ≥90.0 wt. % of aggregates having a C:H atomic ratio in the range of from 1.0 to 1.8, a molecular weight in the range of 250 to 5000, and a melting point in the range of 100° C. to 700° C.

Representative SCTs typically have (i) a TH content in the range of from 5.0 wt. % to 40.0 wt. %, based on the weight of the SCT, (ii) an API gravity (measured at a temperature of 15.8° C.) of ≤8.5° API, such as ≤8.0° API, or ≤7.5° API; and (iii) a 50° C. kinematic viscosity in the range of 600 cSt to $1.0\times10^7$ cSt, as determined by A.S.T.M. D445. The SCT can have, e.g., a sulfur content that is >0.5 wt. %, e.g., in the range of 0.5 wt. % to 7.0 wt. %, based on the weight of the SCT. In aspects where steam cracking feed does not contain an appreciable amount of sulfur, the SCT can comprise ≤0.5 wt. % sulfur, e.g., ≤0.1 wt. %, such as ≤0.05 wt. % sulfur, based on the weight of the SCT.

The SCT can have, e.g., (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.19 g/cm$^3$, e.g., in the range of 1.07 g/cm$^3$ to 1.18 g/cm$^3$; and (iv) a 50° C. kinematic viscosity in the range of 700 cSt to $1.0\times10^7$ cSt. The specified hydroprocessing is particularly advantageous for SCTs having density at 15° C. that is ≥1.10 g/cm$^3$, e.g., ≥1.12 g/cm$^3$, ≥1.14 g/cm$^3$, ≥1.16 g/cm$^3$, or ≥1.17 g/cm$^3$. Optionally, the SCT has a kinematic viscosity at 50° C.≥$1.0\times10^4$ cSt, such as ≥$1.0\times10^5$ cSt, or ≥$1.0\times10^6$ cSt, or even ≥$1.0\times10^7$ cSt. Optionally, the SCT has an $I_N$>80 and >70 wt. % of the pyrolysis tar's molecules have an atmospheric boiling point of ≥290° C.

Optionally, the SCT has a normal boiling point ≥290° C., a kinematic viscosity at 15° C.≥$1\times10^4$ cSt, and a density ≥1.1 g/cm$^3$. The SCT can be a mixture which includes a first SCT and one or more additional pyrolysis tars, e.g., a combination of the first SCT and one or more additional SCTs. When the SCT is a mixture, it is typical for at least 70 wt. % of the mixture to have a normal boiling point of at least 290° C., and include olefinic hydrocarbon which contribute to the tar's reactivity under hydroprocessing conditions. When the mixture comprises a first and second pyrolysis tars (one or more of which is optionally an SCT)≥90 wt. % of the second pyrolysis tar optionally has a normal boiling point ≥290° C.

It has been found that an increase in reactor fouling occurs during hydroprocessing of a tar-fluid mixture comprising an SCT having an excessive amount of olefinic hydrocarbon. In order to lessen the amount of reactor fouling, it is beneficial for an SCT in the tar-fluid mixture to have an olefin content of ≤10.0 wt. % (based on the weight of the SCT), e.g., ≤5.0 wt. %, such as ≤2.0 wt. %. More particularly, it has been observed that less reactor fouling occurs during the hydroprocessing when the SCT in the tar-fluid mixture has (i) an amount of vinyl aromatics of ≤5.0 wt. % (based on the weight of the SCT), e.g., ≤3 wt. %, such as ≤2.0 wt. % and/or (ii) an amount of aggregates which incorporate vinyl aromatics of ≤5.0 wt. % (based on the weight of the SCT), e.g., ≤3 wt. %, such as ≤2.0 wt. %.

In certain aspects, the pyrolysis tar (which may be a blend of one or more tars) is selected from among those where at least 70 wt. % of the pyrolysis tar mixture's components have a normal boiling point of at least 290° C., and optionally having an $I_N$>80.

Certain aspects of the invention include combining SCT with a specified amount of a specified utility fluid to produce a tar-fluid mixture, determining the reactivity $R_M$ the tar-fluid mixture, comparing $R_M$ and a pre-determined reference reactivity $R_{Ref}$, and then using the comparison to select processing options for the SCT. Certain forms of utility fluid and tar-fluid mixtures will now be described in more detail. The invention is not limited to these forms, and this description is not meant to foreclose using other utility fluids and tar-fluid mixtures within the broader scope of the invention.

Utility Fluids

The utility fluid typically comprises a mixture of multi-ring compounds. The rings can be aromatic or non-aromatic, and can contain a variety of substituents and/or heteroatoms. For example, the utility fluid can contain ring compounds in an amount ≥40.0 wt. %, ≥45.0 wt. %, ≥50.0 wt. %, ≥55.0 wt. %, or ≥60.0 wt. %, based on the weight of the utility fluid. In certain aspects, at least a portion of the utility fluid is obtained from the hydroprocessor effluent, e.g., by one or more separations. This can be carried out as disclosed in U.S. Pat. No. 9,090,836, which is incorporated by reference herein in its entirety.

Typically, the utility fluid comprises aromatic hydrocarbon, e.g., ≥25.0 wt. %, such as ≥40.0 wt. %, or ≥50.0 wt. %, or ≥55.0 wt. %, or ≥60.0 wt. % of aromatic hydrocarbon, based on the weight of the utility fluid. The aromatic hydrocarbon can include, e.g., one, two, and three ring aromatic hydrocarbon compounds. For example, the utility fluid can comprise ≥15 wt. % of 2-ring and/or 3-ring aromatics, based on the weight of the utility fluid, such as ≥20 wt. %, or ≥25.0 wt. %, or ≥40.0 wt. %, or ≥50.0 wt. %, or ≥55.0 wt. %, or ≥60.0 wt. %. Utilizing a utility fluid comprising aromatic hydrocarbon compounds having 2-rings and/or 3-rings is advantageous because utility fluids containing these compounds typically exhibit an appreciable $S_{BN}$.

The utility fluid typically has an A.S.T.M. D86 10% distillation point ≥60° C. and a 90% distillation point ≤425° C., e.g., ≤400° C. In certain aspects, the utility fluid has a true boiling point distribution with an initial boiling point ≥130° C. (266° F.) and a final boiling point ≤566° C. (1050° F.). In other aspects, the utility fluid has a true boiling point distribution with an initial boiling point ≥150° C. (300° F.) and a final boiling point ≤430° C. (806° F.). In still other aspects, the utility has a true boiling point distribution with an initial boiling point ≥177° C. (350° F.) and a final boiling point ≤425° C. (797° F.). True boiling point distributions (the distribution at atmospheric pressure) can be determined, e.g., by conventional methods such as the method of A.S.T.M. D7500. When the final boiling point is greater than that specified in the standard, the true boiling point distribution can be determined by extrapolation. A particular form of the utility fluid has a true boiling point distribution having an initial boiling point ≥130° C. and a final boiling point ≤566° C.; and/or comprises ≥15 wt. % of two ring and/or three ring aromatic compounds.

The tar-fluid mixture is produced by combining the pyrolysis tar with a sufficient amount of utility fluid for the tar-fluid mixture to have a viscosity that is sufficiently low for the tar-fluid mixture to be conveyed to hydroprocessing, e.g., a 50° C. kinematic viscosity of the tar-fluid mixture that is ≤500 cSt. The amounts of utility fluid and pyrolysis tar in the tar-fluid mixture to achieve such a viscosity are generally in the range of from about 20.0 wt. % to about 95.0 wt. % of the pyrolysis tar and from about 5.0 wt. % to about 80.0 wt. % of the utility fluid, based on total weight of tar-fluid mixture. For example, the relative amounts of utility fluid and pyrolysis tar in the tar-fluid mixture can be in the range of (i) about 20.0 wt. % to about 90.0 wt. % of the pyrolysis tar and about 10.0 wt. % to about 80.0 wt. % of the utility fluid, or (ii) from about 40.0 wt. % to about 90.0 wt. % of the pyrolysis tar and from about 10.0 wt. % to about 60.0 wt. % of the utility fluid. The utility fluid:pyrolysis tar weight ratio is typically ≥0.01, e.g., in the range of 0.05 to 4.0, such as in the range of 0.1 to 3.0, or 0.3 to 1.1. In certain aspects, particularly when the pyrolysis tar comprises a representative SCT, the tar-fluid mixture can comprise 50 wt. % to 70 wt. % of pyrolysis tar, with ≥90 wt. % of the balance of the tar-fluid mixture comprising the specified utility fluid, e.g., ≥95 wt. %, such as ≥99 wt. %. Although the utility fluid can be combined with the pyrolysis tar to produce the tar-fluid mixture within the hydroprocessing stage, it is typical to combine the pyrolysis tar and utility fluid upstream of the hydroprocessing, e.g., by adding utility fluid to the pyrolysis tar.

In certain aspects, the pyrolysis tar is combined with a utility fluid to produce a tar-fluid mixture to be used as a hydroprocessor feed. Typically these aspects feature one or more of (i) a utility fluid having an $S_{BN}$≥100, e.g., $S_{BN}$≥110; (ii) a pyrolysis tar having an $I_N$≥70, e.g., ≥80; and (iii) >70 wt. % of the pyrolysis tar resides in compositions having an atmospheric boiling point ≥290° C., e.g., ≥80 wt. %, or ≥90 wt. %. The tar-fluid mixture used as hydroprocessor feed can have, e.g., an $S_{BN}$≥110, such as ≥120, or ≥130. It has been found that there is a beneficial decrease in reactor plugging when hydroprocessing pyrolysis tars having an $I_N$>110 provided that, after being combined with the utility fluid, the hydroprocessor feed has an $S_{BN}$≥150, ≥155, or ≥160. The pyrolysis tar can have a relatively large insolubility number, e.g., $I_N$>80, especially >100, or >110, provided the utility fluid has relatively large $S_{BN}$, e.g., $S_{BN}$≥100, ≥120, or ≥140.

Determining Reactivity $R_M$ of a Tar-Fluid Mixture

The fouling tendency (e.g., the reactivity) of a pyrolysis tar in a tar-fluid mixture during hydroprocessing varies from one batch to another depending upon, for example, the pyrolysis tar's thermal history during pyrolysis and thereafter. Pyrolysis tar reactivity has been found to be well-correlated with the tar's olefinic hydrocarbon content, particularly the tar's aliphatic olefin content, and more particularly the tar's vinyl aromatic content. The tar remains reactive even after it is combined with the specified amount of the specified utility fluid to produce the tar-fluid mixture. Reactivity of a tar-fluid mixture $R_M$ and reference reactivity $R_{Ref}$ can be determined by any convenient method, e.g., by measuring Bromine Number expressed in units of BN.

Determining $R_M$ by Bromine Number

Pyrolysis tar reactivity $R_T$ and reactivity of the tar-fluid mixture $R_M$ have been found to be well-correlated with the tar's aliphatic olefin content, especially the content of styrenic hydrocarbons and dienes. While not wishing to be bound by any particular theory, it is believed that aliphatic olefin compounds in the tar (i.e., the tar's aliphatic olefin components) have a tendency to polymerize during hydroprocessing, leading to the formation of coke precursors that are capable of plugging or otherwise fouling the reactor. Fouling is more prevalent in the absence of hydrogenation by catalysts, such as in the preheater and dead volume zones of a hydroprocessing reactor. As a result, certain measures of the tar's aliphatic olefin content, e.g., BN, are well-correlated with tar reactivity, and, $R_M$, $R_T$ and $R_{Ref}$ can be expressed in BN units, i.e., the amount of bromine (as $Br_2$) in grams consumed (e.g., by reaction and/or sorption) by 100 grams of a pyrolysis tar sample. Bromine Index ("BI") can be used instead of or in addition to BN measurements, where BI is the amount of $Br_2$ mass in mg consumed by 100 grams of pyrolysis tar.

In continuous or semi-continuous processing, it is convenient to withdraw an SCT sample from an SCT source, e.g., bottoms of a flash drum separator, a tar storage tank, etc. For example, an SCT sample can be obtained after the tar is separated from the quenched effluent, for instance sampling the tar as a bottoms (primarily liquid) portion of a flash drum separator, such as sampling from line 63 in FIG. 1. Accordingly, in certain aspects an SCT sample is provided at a temperature in a range of 140° C. to 310° C., e.g., 190° C. to 270° C. The SCT sample is combined with sufficient utility fluid to achieve a predetermined 50° C. kinematic viscosity in the tar-fluid mixture, typically ≤500 cSt. Those skilled in the art will appreciate that the amount of SCT in the SCT sample is not critical provided the sample contains sufficient tar to produce a tar-fluid mixture for carrying out the BN measurement. Although the BN measurement can be carried out with the tar-fluid mixture at an elevated temperature, it is typical to cool the tar-fluid mixture to a temperature of about 25° C. before carrying out the BN measurement to determine the olefinic hydrocarbon content of the tar-fluid mixture.

Conventional methods for measuring BN of a heavy hydrocarbon can be used for determining $R_M$, but the invention is not limited thereto. For example, BN of a tar-fluid mixture can be determined by extrapolation from conventional BN methods as applied to light hydrocarbon streams, such as electrochemical titration, e.g., as specified in A.S.T.M. D-1159; colorimetric titration, as specified in A.S.T.M. D-1158; and coulemetric Karl Fischer titration. Typically, the titration is carried out on a tar sample having a temperature ≤ambient temperature, e.g., ≤25° C. Although the cited A.S.T.M. standards are indicated for samples of lesser boiling point, it has been found that they are also applicable to measuring pyrolysis tar BN. Suitable methods for doing so are disclosed by D. J. Ruzicka and K. Vadum in Modified Method Measures Bromine Number of Heavy Fuel Oils, Oil and Gas Journal, Aug. 3, 1987, 48-50; which is incorporated by reference herein in its entirety. Alternatively, an iodine number measurement (using, e.g., A.S.T.M. D4607 method, WIJS Method, or the Hübl method) can be used as an alternative to BN for establishing one or more of $R_M$, $R_T$, and $R_{Ref}$. BN may be approximated from Iodine Number by the formula:

$$BN \sim \text{Iodine Number} * (\text{Atomic Weight of } I_2)/(\text{Atomic Weight of } Br_2).$$

Suitable methods for determining $R_{Ref}$ will now be described in more detail. The invention is not limited to these methods, and this description is not meant to foreclose the use of other methods for measuring $R_{Ref}$ within the broader scope of the invention.

Determining $R_{Ref}$

A reference reactivity $R_{Ref}$ can be established for a wide range of process conditions within the Standard Hydroprocessing Conditions. Although $R_{Ref}$ for particular process conditions (or a set of particular process conditions spanning the entire range of Standard Hydroprocessing Conditions) can be determined from modeling studies, e.g., by modeling the yield of heavy hydrocarbon deposits under selected hydroprocessing conditions, it is typically more convenient to determine $R_{Ref}$ empirically.

One method to determine $R_{Ref}$ includes providing a set of approximately ten pyrolysis tars (or mixtures thereof). Each pyrolysis tar in the set has an olefinic hydrocarbon content different from that of the others (ideally the olefinic hydrocarbon content values are substantially equally spaced). A tar-fluid mixture is produced from each pyrolysis tar in the set by combining each pyrolysis tar with a predetermined amount of the specified utility fluid. Substantially the same predetermined amount of substantially the same utility fluid is used to prepare each tar-fluid mixture in the set. Although the predetermined utility fluid amount can be selected from a wide range of values, it is generally selected to achieve a 50° C. kinematic viscosity for all tar-fluid mixtures in the set that is ≤500 cSt. Typically, the amount of pyrolysis tar is in the range of 50 wt. % to 70 wt. %, with ≥90 wt. % of the balance being the specified utility fluid, e.g., ≥95 wt. %, such as ≥99 wt. %. For example, the predetermined amount of utility fluid can be about 40 wt. %, such as when each tar-fluid mixture comprises about 60 wt. % of a pyrolysis tar in the set and about 40 wt. % (the predetermined amount) of the specified utility fluid. A table of reactivity ("R") values can be produced by hydroprocessing each tar-fluid mixture in the set at a plurality of preselected hydroprocessing conditions within the Standard Hydroprocessing Conditions (e.g., conditions of increasing severity). At each of the preselected hydroprocessing conditions, $R_{Ref}$ corresponds to the $R_M$ of the tar-fluid mixture having the greatest $R_M$ (among those in the tar-fluid set) for which reactor fouling is not observed, e.g., as would otherwise be indicated by a reactor pressure-drop that exceeds a predetermined value before a pre-determined hydroprocessing time duration has elapsed. For example, reactor fouling may be indicated when the reactor pressure-drop that exceeds the start-of-run reactor pressure-drop by a predetermined value of 5% or more after a pre-determined hydroprocessing time duration of thirty days or less. When it is desired to designate as a feed for hydroprocessing a tar-fluid mixture that is not a member of the foregoing set under particular hydroprocessing conditions within the Standard Hydroprocessing Conditions, $R_M$ of the tar-fluid mixture is measured. This value of $R_M$ is compared to that R selected among the tabulated $R_{Ref}$ values which most closely corresponds to the selected hydroprocessing conditions. Hydroprocessing of the designated pyrolysis tar can be carried out efficiently with little or no reactor fouling at the selected Standard Hydroprocessing Conditions when $R_M$ is less than $R_{Ref}$, e.g., ≤75% of $R_{Ref}$, such as ≤50% of $R_{Ref}$, or ≤25% of $R_{Ref}$, or ≤10% of $R_{Ref}$.

As an example, hydroprocessing a tar-fluid mixture comprising the specified utility fluid and a representative pyrolysis tar under preselected hydroprocessing conditions within the specified Standard Hydroprocessing Conditions, e.g., average bed temperature ≥480° C. (e.g., ≥500° C.) and an average pyrolysis tar residence time in the reactor of at least 120 seconds (such as at least 160 seconds), $R_{Ref}$ is typically ≤12 BN, e.g., ≤11 BN, such as ≤10 BN, or ≤9 BN, or ≤8 BN.

Comparing $R_M$ and $R_{Ref}$

In certain aspects, $R_M$ is compared with a pre-determined $R_{Ref}$ as follows. A reference reactivity $R_{Ref}$ is predetermined, as specified for the desired hydroprocessing conditions. A sample of a pyrolysis tar is withdrawn from a pyrolysis tar source. The sample is combined with a sufficient amount of the specified utility fluid sample to achieve a 50° C. kinematic viscosity ≤500 cSt, typically 30 wt. % to 50 wt. % of utility fluid based on the weight of the tar-fluid mixture. $R_M$ of the tar-fluid mixture is measured, e.g., using BN. If $R_M$ is ≤$R_{Ref}$, at least a portion of the remainder of the pyrolysis tar in the pyrolysis tar source (e.g., at least a portion of tar remaining after the sample is removed) can be combined with the specified utility fluid (in substantially the same relative amounts as in the tested tar-fluid mixture) to produce a tar-fluid mixture which is conducted as feed to a hydroprocessing stage for hydroprocessing under Standard Hydroprocessing Conditions. If $R_M$ is >$R_{Ref}$ but ≤18 BN, at least a portion of the remainder of the pyrolysis tar in the pyrolysis tar source can be combined with the specified utility fluid (in substantially the same relative amounts as in the tested tar-fluid mixture) to produce a tar-fluid mixture which is conducted as feed to a hydroprocessing stage for hydroprocessing under Mild Hydroprocessing Conditions. When the sampled pyrolysis tar's tar-fluid mixture has an $R_M$>18 BN, at least a portion of the remainder of the pyrolysis tar can be conducted away without hydroprocessing, e.g., for storage or other processing. More typically, however, such a tar is treated (e.g., by blending with a pyrolysis tar of lesser $R_T$ and/or one or more thermal treatments) to produce a treated tar which, when combined with the specified amount of the specified utility fluid, produces a tar-fluid mixture having an $R_M$≤18 BN, and preferably ≤$R_{Ref}$. Treatment of the pyrolysis tar can be repeated (e.g., by re-treating a treated pyrolysis tar), to produce a re-treated pyrolysis tar which, when combined with the specified amount of the specified utility fluid, produces a tar-fluid mixture having an $R_M$≤18 BN, and preferably ≤$R_{Ref}$. The specified treatments and re-treatments can be carried out until the tar-fluid mixture comprising the treated (or re-treated) tar has an $R_M$ that is ≤18, preferably until $R_M$ does not exceed $R_{Ref}$ by a desired amount (e.g., $R_M$≤25% of $R_{Ref}$), or until further re-treatments are not warranted, as may be the case these would not result in an economic or processing benefit.

Treating or Re-Treating a Pyrolysis Tar by Thermal Treatment

A pyrolysis tar's $R_T$ (measured on a tar basis), and the $R_M$ of a tar-fluid mixture produced from that tar, can be decreased (e.g., improved) by one or more thermal treatments of the pyrolysis tar. Conventional thermal treatments are suitable for heat treating pyrolysis tar, including heat soaking, but the invention is not limited thereto. Although $R_M$ of a tar-fluid mixture can be improved by blending the pyrolysis tar with a second pyrolysis tar of lesser olefinic hydrocarbon content, it is more typical to improve $R_T$ (and hence $R_M$) by thermal treatment of the pyrolysis tar. It is believed that the specified thermal treatment is particularly effective for decreasing the tar's aliphatic olefin content. For example, when $R_M$ of the tar-fluid mixture is in the range of from 19 BN to 35 BN, a thermal treatment of the pyrolysis tar before combining the treated pyrolysis tar with the utility fluid can result in tar-fluid mixture comprising the thermally-treated tar, the mixture having an $R_M$≤18 BN.

One representative pyrolysis tar is an SCT ("SCT1") having an $R_T$>28 BN (on a tar basis), such as $R_T$ of about 35; a density at 15° C. that is ≥1.10 g/cm$^3$; a 50° C. kinematic viscosity in the range of ≥1.0×10$^4$ cSt; an $I_N$>80; wherein ≥70 wt. % of SCT1's hydrocarbon components have an atmospheric boiling point of ≥290° C. SCT1 can be obtained from an SCT source, e.g., from the bottoms of a separator drum (such as a tar drum) located downstream of steam cracker effluent quenching. The thermal treatment can include maintaining SCT1 to a temperature in the range of from $T_1$ to $T_2$ for a time $\geq t_H$s. $T_1$ is ≥150° C., e.g., ≥160° C., such as ≥170° C., or ≥180° C., or ≥190° C., or ≥200° C. $T_2$ is ≤320° C., e.g., ≤310° C., such as ≤300° C., or ≤290° C., and $T_2$ is $\geq T_1$. $t_{HS}$ is ≥1 minute, e.g., ≥10 minutes, such as ≥100 minutes, or typically in the range of from 1 minute to 400 minutes. Provided $T_2$ is ≤320° C., utilizing a $t_{HS}$ of ≥10 min, e.g., ≥50 min, such as ≥100 min typically produces a better treated tar over those produced at a lesser $t_{HS}$.

Although the invention is not limited thereto, the heating can be carried out in a lower section of the tar drum and/or in SCT piping and equipment associated with the tar knock out drum. For example, it is typical for a tar drum to receive quenched steam cracker effluent containing SCT. While the steam cracker is operating in pyrolysis mode, SCT accumulates in a lower region of the tar drum, from which the SCT is continuously withdrawn to prevent an over-accumulation of SCT in the drum. A portion of the withdrawn SCT can be reserved for measuring one or more of $R_T$, $R_M$ and $R_{Ref}$. The remainder of the withdrawn SCT can be conducted away from the tar drum and divided into two separate SCT streams. Typically, at least a portion of any solids present in the withdrawn SCT stream (particularly those having a particle size >10,000 μm) are removed before the stream is divided. At least a portion of the first stream (a recycle portion) is recycled to the lower region of the tar drum. At least a recycle portion of the second stream is also recycled to the lower region of the tar drum, e.g., separately or together with the recycle portion of the first stream. Typically, ≥75 wt. % of the first stream resides in the recycled portion, e.g., ≥80 wt. %, or ≥90 wt. %, or ≥95 wt. %. Typically, ≥40 wt. % of the second stream resides in the recycled portion, e.g., ≥50 wt. %, or ≥60 wt. %, or ≥70 wt. %. Optionally, a storage portion is also divided from the second stream, e.g., for storage in tar tankage. Typically, the storage portion is ≥90 wt. % of the remainder of the second stream after the recycle portion is removed.

Typically, the recycle portion of the first stream has an average temperature that is no more than 60° C. less than the average temperature of the SCT in the lower region of the tar drum, e.g., no more than 50° C. less, or no more than 25° C. less, or no more than 10° C. less. This can be achieved, e.g., by thermally insulating the piping and equipment for conveying the first stream to the tar drum. The second stream, or the recycle portion thereof, is cooled to an average temperature that is (i) less than that of the recycle portion of the first stream and (ii) at least 60° C. less than the average temperature of the SCT in the lower region of the tar drum, e.g., at least 70° C. less, such as at least 80° C. less, or at least 90° C. less, or at least 100° C. less. This can be achieved by cooling the second stream, e.g., using one or more heat exchangers. Utility fluid can be added to the second stream as a flux if needed. If utility fluid is added to the second stream, the amount of added utility fluid flux is taken into account when additional utility fluid is combined with SCT to produce a tar-fluid mixture to achieve a desired tar:fluid weight ratio within the specified range.

Thermal treatment or re-treatment of the SCT can be controlled by regulating (i) the weight ratio of the recycled portion of the second stream:the withdrawn SCT stream and (ii) the weight ratio of the recycle portion of the first stream:recycle portion of the second stream. Controlling one or both of these ratios has been found to be effective for maintaining and average temperature of the SCT in the lower region of the tar drum in the desired ranges of $T_1$ to $T_2$ for a treatment time $t_{HS}$≥1 minute. A greater SCT recycle rate corresponds to a greater SCT residence time at elevated temperature in the tar drum and associated piping, and typically increases the height of the tar drum's liquid level (the height of liquid SCT in the lower region of the tar drum, e.g., proximate to the boot region). Typically, the weight ratio of the recycled portion of the second stream:the withdrawn SCT stream is ≤0.5, e.g., ≤0.4, such as ≤0.3, or ≤0.2, or in the range of from 0.1 to 0.5. Typically, the weight ratio of the recycle portion of the first stream:recycle portion of the second stream is ≤5, e.g., ≤4, such as ≤3, or ≤2, or ≤1, or ≤0.9, or ≤0.8, or in the range of from 0.6 to 5. Although it is not required to maintain the average temperature of the SCT in the lower region of the tar drum at a substantially constant value ($T_{HS}$), it is typical to do so. $T_{HS}$ can be, e.g., in the range of from 150° C. to 320° C., such as 160° C. to 310° C., or ≥170° C. to 300° C. In certain aspects, the thermal treatment conditions include (i) $T_{HS}$ is at least 10° C. greater than $T_1$ and (ii) $T_{HS}$ is in the range of 150° C. to 320° C. For example, typical $T_{HS}$ and His ranges include 180° C.≤$T_{HS}$≤320° C. and 5 minutes≤$t_{HS}$≤100 minutes; e.g., 200° C.≤$T_{HS}$≤280° C. and 5 minutes ≤$t_{HS}$≤30 minutes. Provided $T_{HS}$ is ≤320° C., utilizing a $t_{HS}$ of ≥10 minutes, e.g., ≥50 minutes, such as ≥100 minutes typically produces a better treated tar over those produced at a lesser $t_{HS}$.

The specified thermal treatment is effective for decreasing the representative SCT's $R_T$ to achieve an $R_M$ in the tar-fluid mixture ≤18 BN. For example, the thermal treatment can produce an SCT which when combined with the specified utility fluid produces a tar-fluid mixture having an $R_M \leq 0.9 * R_{Ref}$, such as an $R_M \leq 0.75 * R_{Ref}$, or an $R_M \leq 0.5 * R_{Ref}$, or e.g., $R_M \leq 0.1 * R_{Ref}$. Typically, the thermal treating results in the tar-fluid mixtures having an $R_M$≤18 BN, e.g., ≤16 BN, such as ≤12 BN, or ≤10 BN, or ≤8 BN. Carrying out the thermal treatment at a temperature in the specified temperature range of $T_1$ to $T_2$ for the specified time $t_{HS}$≥1 minute is beneficial in that it substantially lessens the amount of IC in the treated tar as compared to a treated tar obtained by thermal treatments carried out at a greater temperature. This is particularly the case when $T_{HS}$ is ≤320° C., e.g., ≤300° C., such as ≤250° C., or ≤200° C., and $t_{Hs}$ is ≥10 minutes, such as ≥100 minutes. The lesser IC content, e.g. ≤6 wt. %, such as ≤5 wt. %, or ≤3 wt. %, or ≤2 wt. % increases the suitability of the thermally-treated tar for use as a fuel oil, e.g., a transportation fuel oil, such as a marine fuel oil. It also decreases the need for solids-removal upstream of the hydroprocessing.

Although it is typical to carry out SCT thermal treatment in one or more tar drums and related piping, the invention is not limited thereto For example, when the thermal treatment includes heat soaking, the heat soaking can be carried out at least in part in one or more soaker drums and/or in vessels, conduits, and other equipment (e.g., fractionators, water-quench towers, indirect condensers) associated with, e.g., (i) separating the pyrolysis tar from the pyrolysis effluent and/or (ii) conveying the pyrolysis tar to hydroprocessing. The location of the thermal treatment is not critical. The thermal treatment can be carried out at any convenient location, e.g., after tar separation from the pyrolysis effluent and before hydroprocessing, such as downstream of a tar drum and upstream of mixing the thermally treated tar with utility fluid.

In certain aspects, the pyrolysis tar subjected to thermal treatment comprises SCT or a blend comprising SCT. At least part of the thermal treatment can be carried out as illustrated schematically in FIG. 1. As shown in the figure, quenched effluent from a steam cracker furnace facility is conducted via line 61 to a tar knock out drum 62. Cracked gas is removed from the drum via line 54. SCT condenses in the lower region of the drum (the boot region as shown), and a withdrawn stream of SCT is conducted away from the drum via line 63 to pump 64. After pump 64, the withdrawn stream is divided into a first recycle stream 58 and a second recycle stream 57, are diverted from the withdrawn stream. The first and second recycle streams are combined as recycle to drum 62 via line 59. One or more heat exchangers 55 is provided for cooling the SCT in lines 57 and 65, e.g., against water (not shown). Line 56 provides an optional flux of utility fluid if needed. Valves $V_1$, $V_2$, and $V_3$ regulate the amounts of the withdrawn stream that are directed to the first recycle stream, the second recycle stream, and a stream conducted for hydroprocessing via line 65. Lines 58, 59, and 63 can be insulated to maintain the temperature of the SCT within the desired temperature range for the thermal treatment. The thermal treatment time $t_{HS}$ can be increased by increasing SCT flow through valves $V_1$ and $V_2$, which raises the SCT liquid level in drum 62 from an initial level, e.g., $L_1$, toward $L_2$.

Thermally-treated SCT is conducted through valve $V_3$ and via line 65 toward a hydroprocessing facility comprising at least one hydroprocessing reactor. In the aspects illustrated in FIG. 1 using a representative SCT such as SCT1, the average temperature $T_{HS}$ of the SCT during thermal treatment in the lower region of tar drum (below $L_2$) is in the range of from 200° C. to 275° C., and heat exchanger 55 cools the recycle portion of the second stream to a temperature in the range of from 60° C. to 80° C. Time $t_{HS}$ can be, e.g., ≥10 minutes, such as in the range of from 10 minutes to 30 minutes, or 15 minutes to 25 minutes.

Options available for processing the treated or re-treated tar (each being a pyrolysis tar composition) are based on the results of the comparison of $R_M$ and $R_{Ref}$. If $R_M$ is $\leq R_{Ref}$, the treated tar (e.g., at least a portion of the SCT that remains in tar drum 62 after removing the sample used for measuring $R_M$) can be conducted via line 65 to a hydroprocessing facility where it is combined with utility fluid to produce a hydroprocessor feed for hydroprocessing under Standard Hydroprocessing Conditions. If $R_M$ is $>R_{Ref}$ and $R_M$ is >18 BN, the treated tar or a portion thereof can be re-treated (e.g., by blending and/or additional thermal treatment, such as by increased recycle) to achieve an $R_M \leq 18$ BN, and preferably $R_M \leq R_{Ref}$. A tar-fluid mixture containing treated (or re-treated) SCT satisfying the relationships $R_M > R_{Ref}$ and $R_M \leq 18$ BN can be hydroprocessed under Mild Hydroprocessing Conditions. Typically, however, treating or re-treating (such as additional blending and/or additional heat soaking) is carried out to achieve an $R_M \leq 0.9*R_{Ref}$, such as an $R_M \leq 0.75*R_{Ref}$, or an $R_M \leq 0.5*R_{Ref}$, or e.g., $R_M \leq 0.1*R_{Ref}$; or $R_M \leq 18$ BN, e.g., ≤12 BN, such as ≤10 BN, or ≤8 BN.

In continuous operation, the SCT present in the tar-fluid mixture that is conducted as feed for hydroprocessing via line 65 typically comprises ≥50 wt. % of SCT available for processing in drum 62, such as SCT, e.g., ≥75 wt. %, such as ≥90 wt. %. In certain aspects, substantially all of the SCT available for hydroprocessing is combined with the specified amount of the specified utility fluid to produce a tar-fluid mixture which is conducted to hydroprocessing. Depending, e.g., on hydroprocessor capacity limitations, a portion of the SCT in line 64 can be conducted away, such as for storage or further processing, including storage followed by hydroprocessing.

Certain aspects of the invention will now be described with reference to FIG. 1 in which a tar-fluid mixture is a feed for hydroprocessing under the specified hydroprocessing conditions (Standard Hydroprocessing Conditions or Mild Hydroprocessing Conditions, as the case may be) to produce a hydroprocessed pyrolysis tar. The invention is not limited to these aspects, and this description is not meant to foreclose other aspects within the broader scope of the invention.

Hydroprocessing

The SCT feed is typically combined with utility fluid to produce a tar-fluid mixture (a hydroprocessor feed) before hydroprocessing. The hydroprocessor feed is hydroprocessed in the presence of a treatment gas comprising molecular hydrogen, and generally in the presence of at least one catalyst. The hydroprocessing produces a hydroprocessed SCT product (the hydroprocessed pyrolysis tar) that typically exhibits one or more of a decreased viscosity, decreased atmospheric boiling point range, and increased hydrogen content over that of the pyrolysis tar component of the hydroprocessor feed. These features lead in turn to improved compatibility of the tar with other heavy oil blendstocks, and improved utility as a fuel oil and blendstock.

Depending on processing options indicated by the comparison of $R_{Ref}$ and the hydroprocessor feed's $R_M$, the hydroprocessing is carried out under Standard Hydroprocessing Conditions or Mild Hydroprocessing Conditions. The name by which the hydroprocessing is identified is not critical. For example, the hydroprocessing can be characterized as or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing. The hydroprocessing can be carried out in at least one vessel or zone that is located, e.g., within a hydroprocessing stage downstream of the pyrolysis stage and the stage or stages within which the hydroprocessed tar is recovered. Typically, the hydroprocessing temperatures in a hydroprocessing zone is the average temperature of the hydroprocessing reactor's catalyst bed (one half the difference between the bed's inlet and outlet temperature). When the hydroprocessing reactor contains more than one hydroprocessing zone and/or more than one catalyst bed (e.g., as shown in FIG. 1) the hydroprocessing temperature is the average temperature in the hydroprocessing reactor, e.g., (one half the difference between the temperature of the most upstream catalyst bed's inlet and the temperature of the most downstream catalyst bed's outlet temperature).

Hydroprocessing is carried out in the presence of hydrogen, e.g., by (i) combining molecular hydrogen with the hydroprocessor feed upstream of the hydroprocessing, and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. The treat gas optionally contains ≥about 50 vol. % of molecular hydrogen, e.g., ≥about 75 vol. %, based on the total volume of treat gas conducted to the hydroprocessing stage.

Referring again to FIG. 1, SCT in line 65 is combined with utility fluid supplied via line 310 to produce the hydroprocessor feed, which is conducted to a first pre-heater 70 via conduit 320. Optionally, a supplemental utility fluid, may be added via conduit 330. The hydroprocessor feed (which typically is primarily in liquid phase) is conducted to a supplemental pre-heat stage 90 via conduit 370. Combining the SCT with the utility fluid of line 310 and optionally lines 56 and 330 produces a tar-fluid mixture of reactivity $R_M$ for use as hydroprocessor feed. Supplemental pre-heat stage 90 can be, e.g., a fired heater. Recycled treat gas, comprising molecular hydrogen, is obtained from conduit 265 and, if necessary, is mixed with fresh treat gas, supplied through conduit 131. The treat gas is conducted via conduit 60 to a second pre-heater 360, before being conducted to the supplemental pre-heat stage 90 via conduit 80. Fouling in hydroprocessing reactor 110 can be decreased by increasing feed pre-heater duty in pre-heaters 70 and 90. It has surprisingly been found that when $R_M$ is $\leq R_{Ref}$ that pyrolysis tar pre-heater duty can be decreased even when the hydroprocessing is carried out under Standard Hydroprocessing Conditions. Even more surprisingly, it has been found that for a hydroprocessor feed having an $R_M \leq R_{Ref}$ and that is also ≤12 BN, e.g., ≤11 BN, such as ≤10 BN, or ≤8 BN (as can be achieved by one or more of the specified thermal treatments), that it is not necessary to carry out a mild hydroprocessing of the treated tar before hydroprocessing under Standard Hydroprocessing Conditions. This is the case even for an SCT having an initial $R_T$ (before treatment) that is >28 BN.

Continuing with reference to FIG. 1, the pre-heated hydroprocessor feed (from line 380) is combined with the pre-heated treat gas (from line 390) and then conducted via line 100 to hydroprocessing reactor 110. Mixing means can be utilized for combining the pre-heated hydroprocessor feed with the pre-heated treat gas in hydroprocessing reactor 110, e.g., one or more gas-liquid distributors of the type conventionally utilized in fixed bed reactors. The hydroprocessing is carried out in the presence of a catalytically effective amount of at least one hydroprocessing catalyst located in at least one catalyst bed 115. Additional catalyst beds, e.g., 116, 117, etc., may be connected in series with catalyst bed 115, optionally with intercooling quench using treat gas from conduit 60 being provided between beds (not shown).

A hydroprocessor effluent is conducted away from hydroprocessing reactor 110 via conduit 120. When the second and third preheaters (360 and 70) are heat exchangers, the hot hydroprocessing effluent in conduit 120 can be used to preheat the tar/utility fluid and the treat gas respectively by indirect heat transfer. Following this optional heat exchange, the hydroprocessor effluent is conducted to separation stage 130 for separating total vapor product (e.g., heteroatom vapor, vapor-phase cracked products, unused treat gas, etc.) and total liquid product ("TLP") from the hydroprocessed effluent. The total vapor product is conducted via line 200 to upgrading stage 220, which typically comprises, e.g., one or more amine towers. Fresh amine is conducted to stage 220 via line 230, with rich amine conducted away via line 240. Unused treat gas is conducted away from stage 220 via line 250, compressed in compressor 260, and conducted via lines 265, 60, and 80 for re-cycle and re-use in the hydroprocessing stage 110.

The TLP from separation stage 130 typically comprises hydroprocessed pyrolysis tar, e.g., ≥10 wt. % of hydroprocessed pyrolysis tar, such as ≥50 wt. %, or ≥75 wt. %, or ≥90 wt. %. The TLP optionally contains non-tar components, e.g., hydrocarbon having a true boiling point range that is substantially the same as that of the utility fluid (e.g., unreacted utility fluid). The TLP, which is an upgraded tar product, is useful as a diluent (e.g., a flux) for heavy hydrocarbons, especially those of relatively high viscosity. Optionally, all or a portion of the TLP can substitute for more expensive, conventional diluents. Non-limiting examples of heavy, high-viscosity streams suitable for blending with the bottoms include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like. For example, the hydroprocessed tar can be used as a blending component to produce a fuel oil composition comprising <0.5 wt. % sulfur.

In the aspects illustrated in FIG. 1, TLP from separation stage 130 is conducted via line 270 to a further separation stage 280, e.g., for separating from the TLP one or more of hydroprocessed pyrolysis tar, additional vapor, and at last one stream suitable for use as recycle as utility fluid or a utility fluid component. Separation stage 280 may be, for example, a distillation column with side-stream draw although other conventional separation methods may be utilized. An overhead stream, a side stream and a bottoms stream, listed in order of increasing boiling point, are separated from the TLP in stage 280. The overhead stream (e.g., vapor) is conducted away from separation stage 280 via line 290. The bottoms stream (typically comprising a major amount of the hydroprocessed SCT) is conducted away via line 134. At least a portion of the overhead and bottoms streams may be conducted away, e.g., for storage and/or for further processing. The bottoms portion of the TLP can be desirably used as a diluent (e.g., a flux) for heavy hydrocarbon, e.g., heavy fuel oil. In certain aspects, at least a portion of the overhead stream 290 is combined with at least a portion of the bottoms stream 134 to form an upgraded tar product (not shown).

Optionally, the operation of separation stage 280 is adjusted to shift the boiling point distribution of side stream 340 so that side stream 340 has properties desired for the utility fluid, e.g., (i) a true boiling point distribution having an initial boiling point ≥177° C. (350° F.) and a final boiling point ≤566° C. (1050° F.) and/or (ii) an $S_{BN} \geq 100$, e.g., ≥120, such as ≥125, or ≥130. Optionally, trim molecules may be separated, for example, in a fractionator (not shown), from separation stage 280 bottoms or overhead or both and added to the side stream 340 as desired. The side stream is conducted away from separation stage 280 via conduit 340. At least a portion of the side stream 340 can be utilized as utility fluid and conducted via pump 300 and conduit 310. Typically, the side stream composition of line 310 is at least 10 wt. % of the utility fluid, e.g., ≥25 wt. %, such as ≥50 wt. %.

Conventional hydroprocessing catalysts can be utilized for hydroprocessing the pyrolysis tar stream in the presence of the utility fluid, such as those specified for use in residue and/or heavy oil hydroprocessing, but the invention is not limited thereto. Suitable hydroprocessing catalysts include bulk metallic catalysts and supported catalysts. The metals can be in elemental form or in the form of a compound. Typically, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. Suitable conventional catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pre-treat catalyst, such as DN3651 and/or DN3551, available from the same source.

In certain aspects, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In particular aspects, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

Hydroprocessing is carried out under Standard or Mild Hydroprocessing Conditions depending on processing options indicated by the comparison of $R_M$ and $R_{Ref}$. These conditions will now be described in more detail.

Standard Hydroprocessing Conditions

Standard Hydroprocessing Conditions include a temperature ≥200° C., a pressure ≥8 MPa, and a weight hourly space velocity ("WHSV") of the pyrolysis tar component of the hydroprocessor feed that is ≥0.3 $hr^{-1}$. Optionally, the Standard Hydroprocessing Conditions include a temperature >400° C., e.g., in the range of from 300° C. to 500° C., such as 350° C. to 430° C., or 350° C. to 420° C., or 360° C. to 420° C.; and a WHSV in the range of from 0.3 $hr^{-1}$ to 20 $hr^{-1}$ or 0.3 $hr^{-1}$ to 10 $hr^{-1}$. Typically, Standard Hydroprocessing Conditions include a molecular hydrogen partial pressure during the hydroprocessing that is generally ≥8 MPa, such ≥9 MPa, or ≥10 MPa, although in certain aspects it is ≤14 MPa, such as ≤13 MPa, or ≤12 MPa. WHSV of the pyrolysis tar component of the hydroprocessor feed is optionally ≥0.5 $hr^{-1}$, e.g., in the range of from 0.5 $hr^{-1}$ to 20 $hr^{-1}$, such as 0.5 $hr^{-1}$ to 10 $hr^{-1}$. WHSV of the hydroprocessor feed (the tar-fluid mixture) is typically ≥0.5 hr', such as ≥1.0 $hr^{-1}$, or alternatively ≤5 $hr^{-1}$, e.g., ≤4 $hr^{-1}$, or ≤3 $hr^{-1}$.

The amount of molecular hydrogen supplied to a hydroprocessing stage operating under Standard Hydroprocessing Conditions is typically in the range of from about 1000 SCF/B (standard cubic feet per barrel) (178 S $m^3/m^3$) to 10000 SCF/B (1780 S $m^3/m^3$), in which B refers to barrel of hydroprocessor feed to the hydroprocessing stage (the tar-fluid mixture). For example, the molecular hydrogen can be provided in a range of from 3000 SCF/B (534 S $m^3/m^3$) to 6000 SCF/B (1068 S $m^3/m^3$). In another aspect, the rate can be 270 (S $m^3/m^3$) of molecular hydrogen per cubic meter of the pyrolysis tar component of the hydroprocessor feed to 534 S $m^3/m^3$. The amount of molecular hydrogen supplied to hydroprocess the pyrolysis tar component of the hydroprocessor feed is typically less than would be the case if the pyrolysis tar component of the hydroprocessor feed contained greater amounts of aliphatic olefin, e.g., $C_{6+}$ olefin, such as vinyl aromatics. The molecular hydrogen consumption rate during Standard Hydroprocessing Conditions is typically in the range of about 270 standard cubic meters/cubic meter (S $m^3/m^3$) to about 534 S $m^3/m^3$ (1520 SCF/B to 3000 SCF/B, where the denominator represents barrels of the pyrolysis tar component in the hydroprocessor feed, e.g., barrels of SCT in a hydroprocessor feed, e.g., in the range of about 280 to about 430 S $m^3/m^3$, such as about 290 to about 420 S $m^3/m^3$, or about 300 to about 410 S $m^3/m^3$. The indicated molecular hydrogen consumption rate is typical for a pyrolysis tar containing ≤5 wt. % of sulfur, e.g., ≤5 wt. %, such as ≤1 wt. %, or ≤0.5 wt. %. A greater amount of molecular hydrogen is typically consumed when the pyrolysis tar contains a greater sulfur amount.

Within the parameter ranges (T, P, WHSV, etc.) specified for Standard Hydroprocessing Conditions, particular hydroprocessing conditions for a particular pyrolysis tar are typically selected to (i) achieve the desired 566° C.+ conversion, typically ≥20 wt. % substantially continuously for at least ten days, and (ii) produce a TLP and hydroprocessed pyrolysis tar having the desired properties, e.g., the desired density and viscosity. The term 566° C.+ conversion means the conversion during hydroprocessing of pyrolysis tar compounds having boiling a normal boiling point ≥566° C. to compounds having boiling points <566° C. This 566° C.+ conversion includes a high rate of conversion of THs, resulting in a processed pyrolysis tar having desirable properties.

Respecting the properties of TLP and hydroprocessed pyrolysis tar, the density measured at 15° C. of the TLP, and particularly of the hydroprocessed pyrolysis tar, is typically at least 0.10 g/$cm^3$ less than the density of the pyrolysis tar in conduit 63 of FIG. 1). For example, the density of the TLP and/or the hydroprocessed pyrolysis tar can be at least 0.12, preferably, at least 0.14, 0.15, or 0.17 g/$cm^3$ less than the density of the pyrolysis tar component of the hydroprocessor feed. The kinematic viscosity measured at 50° C. of the TLP (and/or the hydroprocessed pyrolysis tar) is typically <200 cSt. For example, the viscosity can be <150 cSt, such as <100 cSt, or <75 cSt, or <50 cSt, or <40 cSt, or <30 cSt. Generally, hydroprocessing under Standard Hydroprocessing Conditions results in a significant viscosity improvement over the pyrolysis tar component of the hydroprocessor feed. For example, when the kinematic viscosity of the raw pyrolysis tar measured at 50° C. is ≥$1.0\times10^4$ cSt, e.g., ≥$1.0\times10^5$ cSt, ≥$1.0\times10^6$ cSt, or ≥$1.0\times10^7$ cSt, the kinematic viscosity of the TLP and/or hydroprocessed tar measured at 50° C. is typically <200 cSt, e.g., <150 cSt, preferably, <100 cSt, <75 cSt, <50 cSt, <40 cSt, or <30 cSt.

For a hydroprocessor feed having an $R_M \leq R_{Ref}$, particularly $2*R_M \leq R_{Ref}$, more particularly $5*R_M \leq R_{Ref}$, and even more particularly $10*R_M \leq R_{Ref}$, the hydroprocessing can be carried out under Standard Hydroprocessing Conditions for a significantly longer duration without significant reactor fouling (e.g., as evidenced by no significant increase in hydroprocessing reactor pressure drop during the desired duration of hydroprocessing, such as a pressure drop of ≤140 kPa during a hydroprocessing duration of 10 days, typically ≤70 kPa, or ≤35 kPa) than is the case under substantially the same hydroprocessing conditions for a tar-fluid mixture having an $R_M > R_{Ref}$. When $2*R_M \leq R_{Ref}$, the duration of hydroprocessing without significantly fouling is typically least 10 times longer than would be the case for a tar-fluid mixture having an $R_M > R_{Ref}$, e.g., ≥100 times longer, such as ≥1000 times longer. In other words, decreasing $R_M$ to a factor of two below $R_{Ref}$ typically increases the duration of hydroprocessing by at least a factor of ten over the duration achieved at $R_M = R_{Ref}$.

An untreated, treated, or re-treated SCT which would produce a tar-fluid mixture having an $R_M$ in the range of from more than $R_{Ref}$ to 18 BN can be conducted away without hydroprocessing. Alternatively or in addition, at least a portion of such an SCT can be combined with utility fluid to produce a tar-fluid mixture having an $R_M$ in the range of from more than $R_{Ref}$ to 18 BN, with at least a portion of the tar-fluid mixture being hydroprocessed under Mild Hydroprocessing Conditions. Such Mild Hydroprocessing Conditions will now be described in more detail. Although hydroprocessing under Mild Hydroprocessing Conditions can be used when $R_M \leq R_{Ref}$, the resulting hydroprocessed pyrolysis tar typically has properties that are not as desirable as those achieved when Standard Hydroprocessing Conditions are used.

Mild Hydroprocessing Conditions

Mild Hydroprocessing Conditions expose the tar-fluid mixture to less severe conditions than is the case when Standard Hydroprocessing Conditions are used. For example, Compared to Standard Hydroprocessing Conditions, Mild Hydroprocessing Conditions utilize one or more of a lesser hydroprocessing temperature, a lesser hydroprocessing pressure, a greater hydroprocessor feed WHSV, a greater pyrolysis tar WHSV, and a lesser molecular hydrogen consumption rate. Within the parameter ranges (T, P, WHSV, etc.) specified for Mild Hydroprocessing Conditions, particular hydroprocessing conditions for a particular pyrolysis tar are typically selected for a desired 566° C.+ conversion, typically in the range of from 0.5 wt. % to 5 wt. % substantially continuously for at least ten days.

For a tar-fluid mixture having an $R_M$ that is substantially equal to $R_{Ref}$, the least severe conditions within the Standard Hydroprocessing Conditions which achieve a 566° C.+ conversion, of ≥20 wt. % substantially continuously for at least ten days are identified as hydroprocessing temperature $T_S$, hydroprocessing pressure $P_S$, pyrolysis tar space velocity $WHSV_S$, and molecular hydrogen consumption ("$C_S$"). Mild Hydroprocessing Conditions include a hydroprocessing temperature $T_M \geq 150°$ C., e.g., ≥200° C. but less than $T_S$ (e.g., $T_M \leq T_S - 10°$ C., such as ≤400° C.), a pressure $P_M$ that is ≥8 MPa but less than $P_S$, a pyrolysis tar $WHSV_M$ that is ≥0.3 $hr^{-1}$ and greater than $WHSV_S$, and a molecular hydrogen consumption rate ("$C_M$") that in the range of from 150 standard cubic meters of molecular hydrogen per cubic meter of the pyrolysis tar (S $m^3/m^3$) to about 400 S $m^3/m^3$ (845 SCF/B to 2250 SCF/B) but less than $C_S$.

Typically, $WHSV_M$ is $>WHSV_S+0.01$ $hr^{-1}$, e.g., $\geq WHSV_S+0.05$ $hr^{-1}$, such as $\geq WHSV_S+0.1$ $hr^{-1}$, or $\geq WHSV_S+0.5$ $hr^{-1}$, or $\geq WHSV_S+1$ $hr^{-1}$, or $\geq WHSV_S+10$ $hr^{-1}$, or more. Typically, Mild Hydroprocessing Conditions utilize a lesser temperature (e.g., average bed temperature) than does Standard hydroprocessing, such as $T_M \leq T_S - 25°$ C., such as $T_M \leq T_S - 50°$ C. For example, $T_M$ can be ≤440° C.

For a hydroprocessor feed having $R_M$ in the range of from $R_{Ref}$ to 18 BN, the hydroprocessing can be carried out under Mild Hydroprocessing Conditions for a significantly longer duration without significant reactor fouling (e.g., as evidenced by no significant increase in hydroprocessing reactor pressure drop) than is the case when hydroprocessing a substantially similar hydroprocessor feed under Standard Hydroprocessing Conditions. The duration of hydroprocessing without significantly fouling is typically at least 10 times longer than would be the case when hydroprocessing a hydroprocessor feed having an $R_M \leq 18$ BN and $R_M > R_{Ref}$ under Standard Hydroprocessing Conditions, e.g., ≥100 times longer, such as ≥1000 times longer.

The greater the amount by which $R_M$ exceeds $R_{Ref}$, up to an including $R_M$=18 BN, the greater the tendency for the pyrolysis tar to foul, and the greater the benefit of using Mild Hydroprocessing Conditions. Although the Mild Hydroprocessing Conditions are effective with such a hydroprocessor feed, the invention is not limited thereto. When $R_M$ is in the range of from more than $R_{Ref}$ to 18 BN, any hydroprocessing conditions that are effective for reducing fouling may be used. For instance, the speed of the reaction may be decreased by further decreasing the amount of molecular hydrogen provided to the hydroprocessing, or increasing the weight hourly space velocity, or reducing hydroprocessing pressure and/or temperature beyond that specified for Mild Hydroprocessing Conditions.

EXAMPLES

Figure 2A:
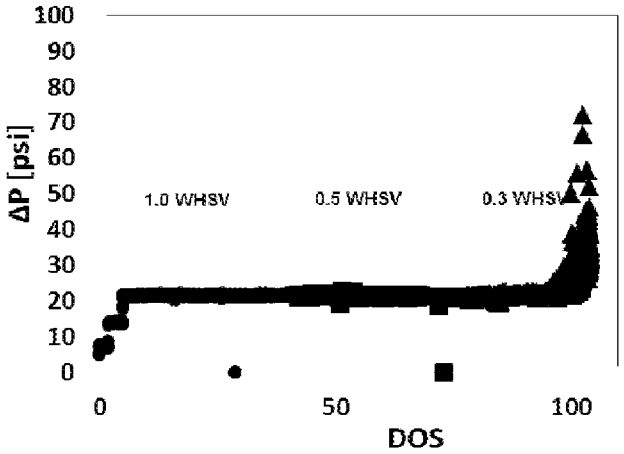
FIG. 2 is a graph of a hydroprocessing reactor pressure drops (in psig) versus days on stream during hydroprocessing in a hydroprocessing for (i) a pyrolysis tar that has been subjected to the specified thermal treatment and (ii) a pyrolysis tar that has not been subjected to the specified thermal treatment.
Figure 2B:
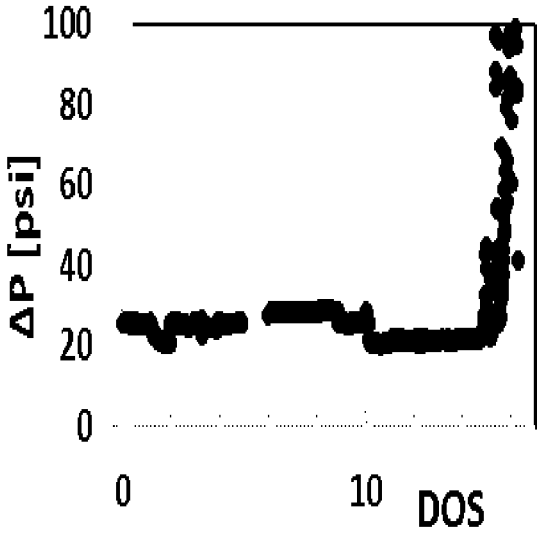

Tar-fluid mixtures containing (i) non-heat soaked and heat soaked pyrolysis tars and (ii) substantially the same amount of the same utility fluid are hydroprocessed over a bed of the specified hydroprocessing catalyst under Standard Hydroprocessing Conditions including a hydroprocessing temperature 400° C., a total pressure of 10 bar (abs.), and a pyrolysis tar WHSV of 1 $h^{-1}$. FIG. 2 shows pressure drop (in pounds per square inch, absolute) across the hydroprocessing as a function of hydroprocessing time (in days on stream, "DOS") for a representative pyrolysis tar that is first subjected to the specified thermal treatment (FIG. 2A) and again with the same pyrolysis tar without the thermal treatment (FIG. 2B). As shown, an increase in reactor pressure drop (an indication of reactor fouling) occurs within 15 days for the non-thermally-treated pyrolysis tar (FIG. 2B), versus more than 90 days on stream when the pyrolysis tar is thermally treated at $T_{HS}$ of 300° C. for a His of approximately 30 minutes (FIG. 2A), even after decreasing WHSV as indicated.

Figure 3:
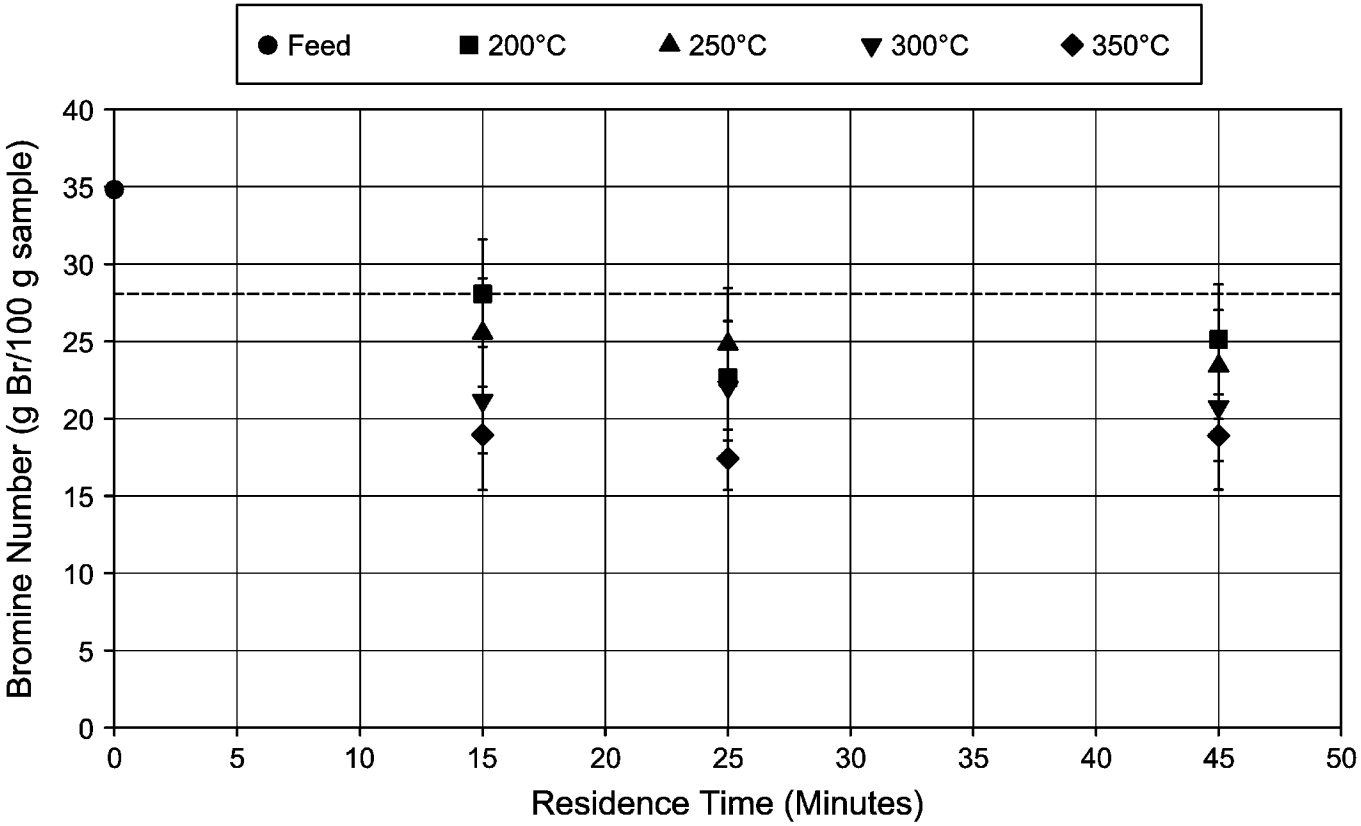
FIG. 3 illustrates the relationship between tar reactivity $R_T$ (as expressed in BN) and thermal treatment parameters $T_{HS}$ and $t_{HS}$.
Figure 4:
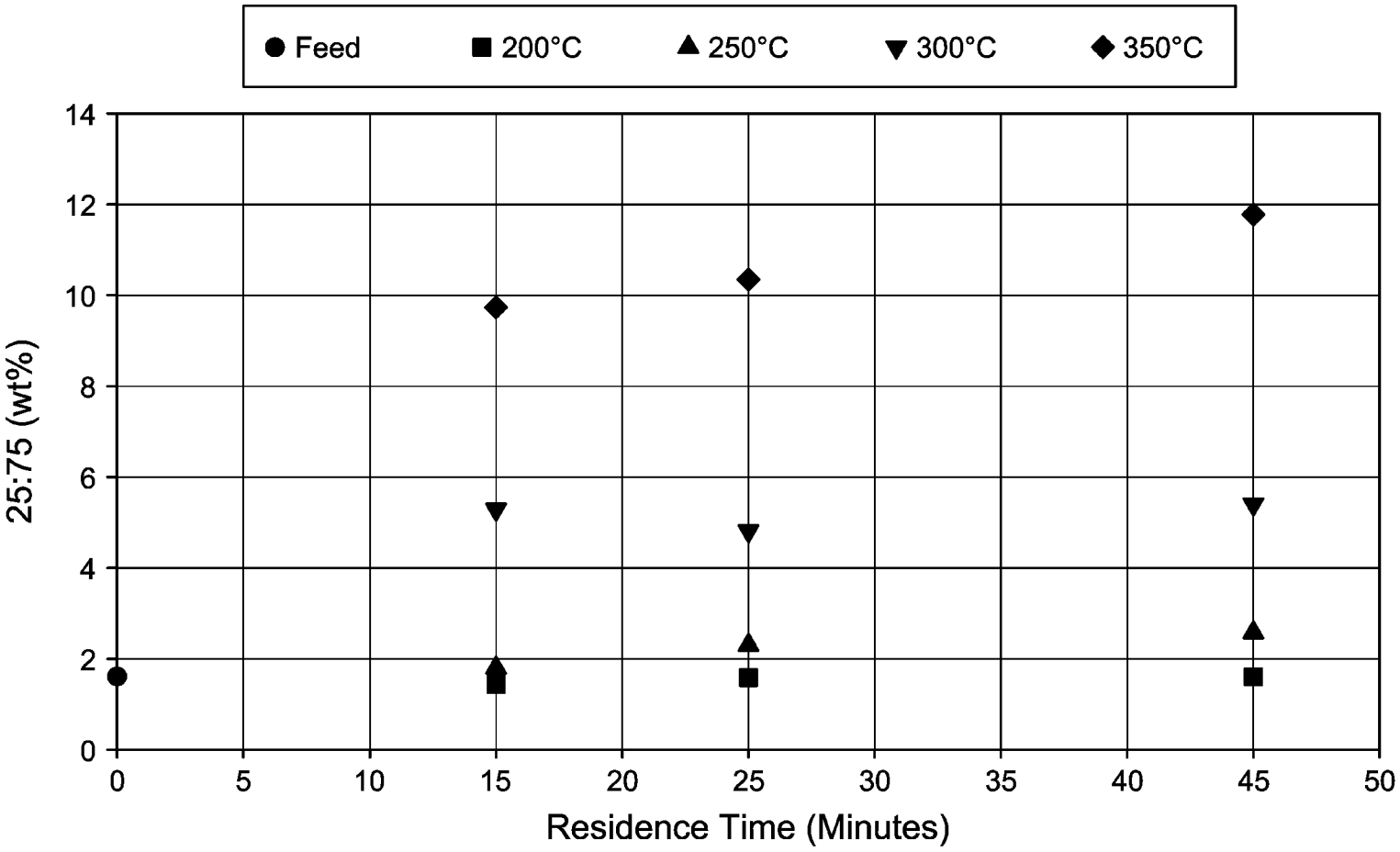
FIG. 4 illustrates the relationship between Insolubles Content (in wt. %) and thermal treatment parameters $T_{HS}$ and $t_{HS}$.

FIG. 4 shows the effect of thermally treating a pyrolysis tar substantially equivalent to SCT1 and having an $R_T$ of about 35 BN at a $T_{HS}$ of 200° C., 250° C., 300° C., and 350° C. At each value of $T_H$s, tar reactivity is measured at a $t_{HS}$ of 15 minutes, 25 minutes, and 45 minutes. Although FIG. 3 shows that the greatest decrease in BN is obtained at $T_{HS}$=350° C., FIG. 4 shows that doing so is undesirable: heat soaking at 350° C. for even 15 minutes increases IC from an initial value of less than 2 wt. % to a final value of more than 9 wt. %. On the other hand, IC does not exceed 6 wt. % when $T_{HS}$=300° C., even when $t_{HS}$ is 45 minutes.

All patents, test procedures, and other documents cited herein, including priority documents, are fully incorporated by reference to the extent such disclosure is not inconsistent and for all jurisdictions in which such incorporation is permitted. While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all patentable features which reside herein, including all features which would be treated as equivalents thereof by those skilled in the art to which this disclosure pertains. Although numerical lower limits and numerical upper limits are listed herein, this description expressly includes ranges from any lower limit to any upper limit.

The invention claimed is:

1. A pyrolysis tar conversion process, comprising:

(a) providing a pyrolysis tar, wherein, at least 70 wt. % of the pyrolysis tar's components have a normal boiling point of at least 290° C., based upon the total weight of the pyrolysis tar;

(b) maintaining the pyrolysis tar within a temperature range of from $T_1$ to $T_2$ for time $t_{HS}$ to produce a pyrolysis tar composition having an Insolubles Content (IC) ≤6 wt. %, wherein $T_1$ is ≥150° C., $T_2$ is ≤320° C., and $t_{HS}$ is ≥1 minute;

(c) combining the pyrolysis tar composition with a sufficient amount of a utility fluid to produce a tar-fluid mixture having a 50° C. kinematic viscosity that is ≤500 cSt;

(d) determining a reactivity $R_M$ of the tar-fluid mixture and comparing $R_M$ to a predetermined reference activity $R_{Ref}$ of a hydroprocessing stage; and (e) when:

(i) $R_M$ is $\leq R_{Ref}$, producing a hydroprocessed tar by hydroprocessing at least a portion of the tar-fluid mixture in the hydroprocessing stage under Standard Hydroprocessing Conditions; and (ii) $R_M$ is both $>R_{Ref}$ and ≤18 Bromine Number ("BN"), producing the hydroprocessed tar by hydroprocessing at least a portion of the tar-fluid mixture in the hydroprocessing stage under Mild Hydroprocessing Conditions.

2. The process of claim 1, wherein the pyrolysis tar has an $R_T$ is in the range of from 29 BN to 45 BN, and the $R_M$ of the tar-fluid mixture is ≤17 BN.

3. The process of claim 1, wherein ≥90 wt. % of the pyrolysis tar components have a normal boiling point ≥290° C., and the pyrolysis tar has a 50° C. kinematic viscosity $\geq 1\times10^4$ cSt and/or a density ≥1.1 g/cm$^3$.

4. The process of claim 1, wherein in the pyrolysis tar is a steam cracker tar having an insolubility number ($I_N$) >80.

5. The process of claim 1, wherein $R_{Ref}$ is ≤11 BN.

6. The process of claim 1, wherein the IC of the pyrolysis tar composition is ≤5 wt. %.

7. The process of claim 1, wherein (i) hydroprocessed tar has a 15° C. density that is at least 0.10 g/cm$^3$ less than that of the pyrolysis tar, and (ii) the hydroprocessed tar has a 50° C. kinematic viscosity <200 cSt.

8. The process of claim 1, further comprising blending the hydroprocessed tar to produce a fuel oil composition comprising <0.5 wt. % sulfur.

9. The process of claim 1, wherein $T_1$ is ≥160° C. and $T_2$ is ≤310° C., and $t_{HS}$ is in the range of from 1 minute to 400 minutes.

10. The process of claim 1, wherein $T_1$ is ≥180° C. and $T_2$ is ≤300° C., and $t_{HS}$ is in the range of from 5 minutes to 100 minutes.

11. The process of claim 1, wherein $T_1$ is ≥200° C. and $T_2$ is ≤290° C., and $t_{HS}$ is in the range of from 5 minutes to 30 minutes.

12. The process of claim 1, wherein $R_{Ref}$ is ≤12 BN, and wherein the temperature at which the pyrolysis tar is maintained is (i) constant at a temperature $T_{HS}$ during $t_{Hs}$ and (ii) $T_{HS}$ is at least 10° C. greater than $T_1$.

13. The process of claim 1, wherein step (e) further comprises:

(iii) when $R_M$ is >18, increasing $T_{HS}$ and/or $t_{HS}$ and repeating steps (c)-(e).

14. The process of claim 1, wherein the utility fluid comprises ≥15 wt. % of combined two-ring and three-ring aromatic hydrocarbon compounds, and wherein the utility fluid has an A.S.T.M. D86 10% distillation point ≥60° C. and a 90% distillation point ≤425° C.

15. The process of claim 1, wherein the hydroprocessing of step (e)(i) exhibits a 566° C.+ conversion of at least 20 wt. % continuously for at least ten days.

16. The process of claim 1, wherein the hydroprocessed pyrolysis tar of step (e)(i) has a density measured at 15° C. that is at least 0.10 g/cm$^3$ less than that of the pyrolysis tar.

17. The process of claim 1, wherein (i) the hydroprocessing of step (e)(i) and/or the hydroprocessing of step (e)(ii) is carried out in the presence of a catalytically effective amount of at least one catalyst, (ii) the catalyst comprises at least one metal from any of Groups 5 to 10 of the Periodic Table, and (iii) the catalyst comprises the metal in an amount in the range of from 0.005 grams to 0.3 grams per gram of catalyst.

18. The process of claim 1, wherein the Standard Hydroprocessing Conditions include a temperature $T_S$≥200° C., a pressure $P_S$≥8 MPa, a weight hourly space velocity ("$WHSV_S$", pyrolysis tar basis) ≥0.3 hr$^{-1}$, and a molecular hydrogen consumption rate $C_S$ in the range of 270 S m$^3$/m$^3$ of molecular hydrogen per cubic meter of the pyrolysis tar (S m$^3$/m$^3$) to 534 S m$^3$/m$^3$.

19. The process of claim 1, wherein the Mild Hydroprocessing Conditions include a temperature $T_M$ that is ≥200° C. but less than $T_S$, a pressure $P_M$ that is ≥8 MPa but less than $P_S$, a $WHSV_M$ of the pyrolysis tar that is ≥0.3 hr$^{-1}$ and greater than $WHSV_S$, and a molecular hydrogen consumption rate ($C_M$) that is in the range of from 150 standard cubic meters of molecular hydrogen per cubic meter of the pyrolysis tar (S m$^3$/m$^3$) to about 400 S m$^3$/m$^3$ (845 SCF/B to 2250 SCF/B), but less than $C_S$.

* * * * *